US010308060B2

(12) United States Patent
Aoyagi et al.

(10) Patent No.: US 10,308,060 B2
(45) Date of Patent: Jun. 4, 2019

(54) SHEET POST-PROCESSING APPARATUS AND IMAGE FORMING SYSTEM

(71) Applicants: Hideki Aoyagi, Misato (JP); Hongchang Sun, Yamanashi-ken (JP)

(72) Inventors: Hideki Aoyagi, Misato (JP); Hongchang Sun, Yamanashi-ken (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 0 days.

(21) Appl. No.: 15/704,653

(22) Filed: Sep. 14, 2017

(65) Prior Publication Data

US 2018/0079247 A1 Mar. 22, 2018

(30) Foreign Application Priority Data

Sep. 14, 2016 (JP) ..... 2016-179235

(51) Int. Cl.

| | |
|---|---|
| ***B31F 5/02*** | (2006.01) |
| ***B42C 1/12*** | (2006.01) |
| ***B65H 1/04*** | (2006.01) |
| ***B65H 1/08*** | (2006.01) |
| ***B65H 3/06*** | (2006.01) |
| ***B65H 29/22*** | (2006.01) |
| ***B65H 31/02*** | (2006.01) |
| ***B65H 37/04*** | (2006.01) |
| ***B65H 43/00*** | (2006.01) |

(Continued)

(52) U.S. Cl.

CPC ..... *B42C 1/12* (2013.01); *B31F 5/02* (2013.01); *B42B 5/00* (2013.01); *B65H 1/04* (2013.01); *B65H 1/08* (2013.01); *B65H 3/0661* (2013.01); *B65H 29/22* (2013.01); *B65H 31/02* (2013.01); *B65H 31/36* (2013.01); *B65H 31/38* (2013.01); *B65H 37/04* (2013.01); *B65H 43/00* (2013.01); *G03G 15/6544* (2013.01); *B65H 2301/4212* (2013.01); *B65H 2301/4213* (2013.01); *B65H 2301/43828* (2013.01); *B65H 2405/11151* (2013.01); *B65H 2801/06* (2013.01); *B65H 2801/27* (2013.01)

(58) Field of Classification Search

CPC .... B65H 37/04; B65H 43/00; B65H 2801/27; B65H 2301/51616; B65H 2301/43838; G03G 15/6544; G03G 2215/00852; B31F 1/07; B31F 5/02; B31F 2201/0712; B31F 2201/0774; B31F 2201/0779

USPC ..... 270/58.07, 58.08, 58.09

See application file for complete search history.

(56) References Cited

U.S. PATENT DOCUMENTS 8,246,033 B2 * 8/2012 Sato ..... B42C 1/12 270/58.07
8,333,372 B2 * 12/2012 Awaya ..... B65H 37/04 270/58.07

(Continued)

FOREIGN PATENT DOCUMENTS

| | | |
|---|---|---|
| JP | 2014-168890 A | 3/2013 |
| JP | 2014-073681 A | 4/2014 |
| JP | 2014-114113 A | 6/2014 |

*Primary Examiner* — Leslie A Nicholson, III

(74) *Attorney, Agent, or Firm* — Manabu Kanesaka

(57) ABSTRACT

A sheet post-processing apparatus includes a binding unit that crimps a predetermined position on a sheet for binding, and a setting unit that sets the number of binding points at which to bind the sheet. The binding unit applies binding to the sheet at different positions as many as the number of binding points set by the setting unit.

10 Claims, 20 Drawing Sheets

(51) Int. Cl.

| | |
|---|---|
| ***B65H 31/36*** | (2006.01) |
| ***B65H 31/38*** | (2006.01) |
| ***B42B 5/00*** | (2006.01) |
| ***G03G 15/00*** | (2006.01) |

(56) References Cited

U.S. PATENT DOCUMENTS

| | | | | |
|---|---|---|---|---|
| 8,342,499 | B2 * | 1/2013 | Shiraishi | B65H 31/3027 270/52.18 |
| 9,415,560 | B2 * | 8/2016 | Morinaga | B42C 13/00 |
| 2016/0360053 | A1 * | 12/2016 | Suzuki | B65H 33/00 |

* cited by examiner

SHEET POST-PROCESSING APPARATUS AND IMAGE FORMING SYSTEM

BACKGROUND OF THE INVENTION

1. Field of the Invention

The present invention relates to a sheet post-processing apparatus for applying binding processing to sheets, and an image forming system including the sheet post-processing apparatus.

2. Description of the Related Art

A sheet post-processing apparatus including a sheet binding mechanism that receives sheets, on which images are formed by an image forming apparatus, on a processing tray and applies binding processing to the sheet bundle on the processing tray has heretofore been known. Among methods for binding a sheet bundle by the sheet post-processing apparatus is a method for sandwiching the sheets between a pair of crimping members having recesses and protrusions of tooth shape, and pressing the sheets to form crimps so that fibers of the sheets are entangled with and fastened to each other.

According to the method for binding a sheet bundle by crimping, if the pressing force between the pair of crimping members is small, sheets of less entangleable fibers, such as sheets of thick paper and sheets of special paper, are likely to exfoliate from the bound sheet bundle. If the pressing force between the pair of crimping members is small, sheets are also likely to exfoliate from a thick sheet bundle. On the other hand, if the pressing force of the crimping members is large, thin paper, plain paper, and thin sheet bundles can be broken or damaged. In other words, there has been a problem that the method cannot accommodate various sheet types since a binding failure or sheet damage occurs depending on the sheet type.

SUMMARY OF THE INVENTION

There is provided a setting unit that sets the number of binding points at which to bind sheets, and binding is applied along a predetermined direction as many times as the number of binding points set by the setting unit.

This facilitates changing fastening force of the sheets, so that appropriate fastening force can be secured according to conditions.

DETAILED DESCRIPTION OF THE PREFERRED EMBODIMENT

Figure 1:
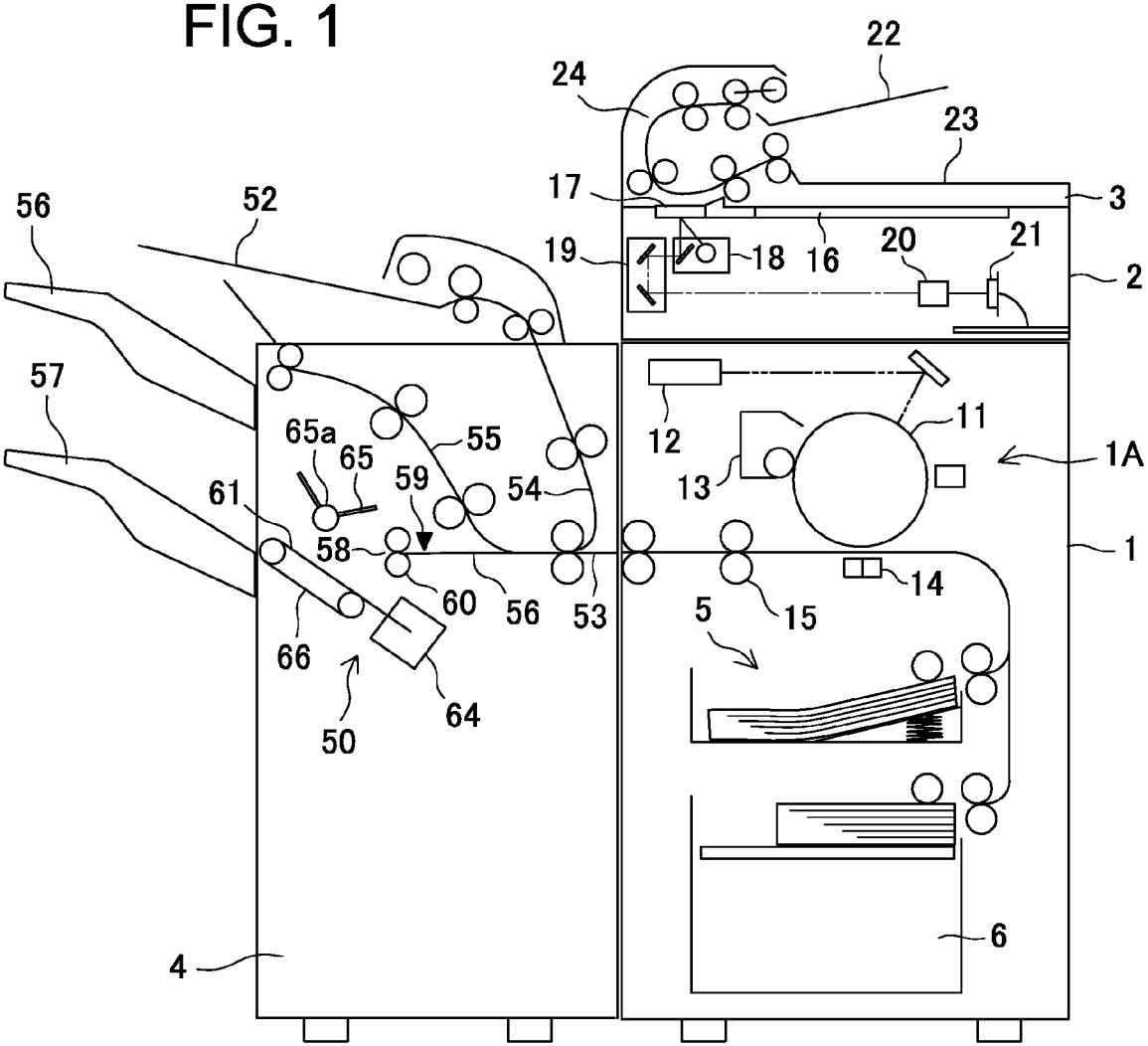
FIG. 1 is a configuration diagram showing an image forming system including a sheet post-processing apparatus according to the present invention.

FIG. 1 shows an overall configuration of an image forming system including a sheet post-processing apparatus according to the present invention. The image forming apparatus shown in the diagram includes an image forming apparatus 1, a document reading apparatus 2, a document feed apparatus 3, and a sheet post-processing apparatus 4. The image forming apparatus 1 includes an image forming unit that prints an image on a sheet. The document reading apparatus 2 reads an image to be printed on a sheet from a document. The document feed apparatus 3 conveys the document to a reading unit of the document reading apparatus 2. The sheet post-processing apparatus 4 is connected to a sheet discharge port of the image forming apparatus 1 and applies post-processing to a sheet discharged from the image forming apparatus 1.

The image forming apparatus 1 includes a cassette 5 which can store about 100 sheets, and a storage 6 which can store about 1000 sheets. The sheets in the cassette 5 or the storage 6 are taken out and sent to an image forming unit 1A one by one.

The image forming unit 1A performs printing on a sheet. The image forming unit 1A includes a beam projector 12, a developing device 13, and a transfer charger 14. The beam projector 12 forms an electrostatic latent image on a photosensitive drum 11. The developing device 13 applies toner ink to the electrostatic latent image. The transfer charger 14 transfers the image ink formed on the photosensitive drum 11 to a sheet. A fixing roller 15 arranged downstream heats and fixes the image on the sheet. The sheet is conveyed to the sheet post-processing apparatus 4.

The document reading apparatus 2 includes a first platen 16 and a second platen 17. The first and second platens 16 and 17 are made of transparent glass and horizontally juxtaposed on an upper part of the apparatus. The first platen 16 is used to read a document that is manually set. The second platen 17 is used to read a document that moves at a predetermined speed.

The document reading apparatus 2 includes a reading carriage 18 and a photoelectric conversion unit inside. The photoelectric conversion unit includes a condenser lens 20 and a photoelectric conversion element 21 such as a CCD image sensor. The reading carriage 18 includes a lamp which emits light to a document, and two mirrors which guide the light reflected from the document to the condenser lens 20 and the photoelectric conversion element 21.

The reading carriage 18 reciprocates in a sub scanning direction (horizontal direction) under the first platen 16. The reading carriage 18 irradiates a document with light, and reads the document by photoelectrically converting the reflected light from the document by the photoelectric conversion element 21. Image data on the document read by the photoelectric conversion element 21 is transmitted as an image signal to the beam projector 12.

The document feed apparatus 3 passes a document set on a sheet feed tray 22 over the second platen 17 by a sheet conveyance mechanism 24, and discharges the document to a sheet discharge tray 23. The reading carriage 18 stops at a position under the second platen 17 and reads the document passing over the second platen 17.

The sheet post-processing apparatus 4 applies binding processing to sheets on which images are formed (printed) by the image forming unit of the image forming apparatus 1. The sheet post-processing apparatus 4 includes a binding part 50, first and second stacking trays 56 and 57, an insert tray 52, a first conveyance path 53, a second conveyance path 54, and a third conveyance path 55. The binding part 50 performs binding processing on sheets. Sheets are discharged to the first and second stacking trays 56 and 57. Sheets such as a document, color paper, and a slip sheet are set on the insert tray 52. The first conveyance path 53 guides a sheet from the image forming apparatus 1 to the binding part 50. The second conveyance path 54 guides a sheet from the insert tray 52 to the binding part 50. The third conveyance path 55 branches off the first conveyance path 53 and guides the sheet from the image forming apparatus 1 to the first stacking tray 56.

The sheet post-processing apparatus 4 further includes a sheet feed mechanism and a plurality of conveyance roller pairs. The sheet feed mechanism separates and feeds the sheets on the insert tray 52 one by one. The plurality of conveyance roller pairs is arranged at appropriate intervals to convey sheets along the first to third conveyance paths 53, 54, and 55. A downstream portion of the first conveyance path 53 and a downstream portion of the second conveyance path 54 constitute a common conveyance path (third conveyance path) 56*a*. A discharge roller pair 60 for discharging a sheet from a discharge port 58 is arranged on the common conveyance path 56*a*. A carry-out sensor 59 detects the sheet conveyed to the discharge port 58.

Figure 2:
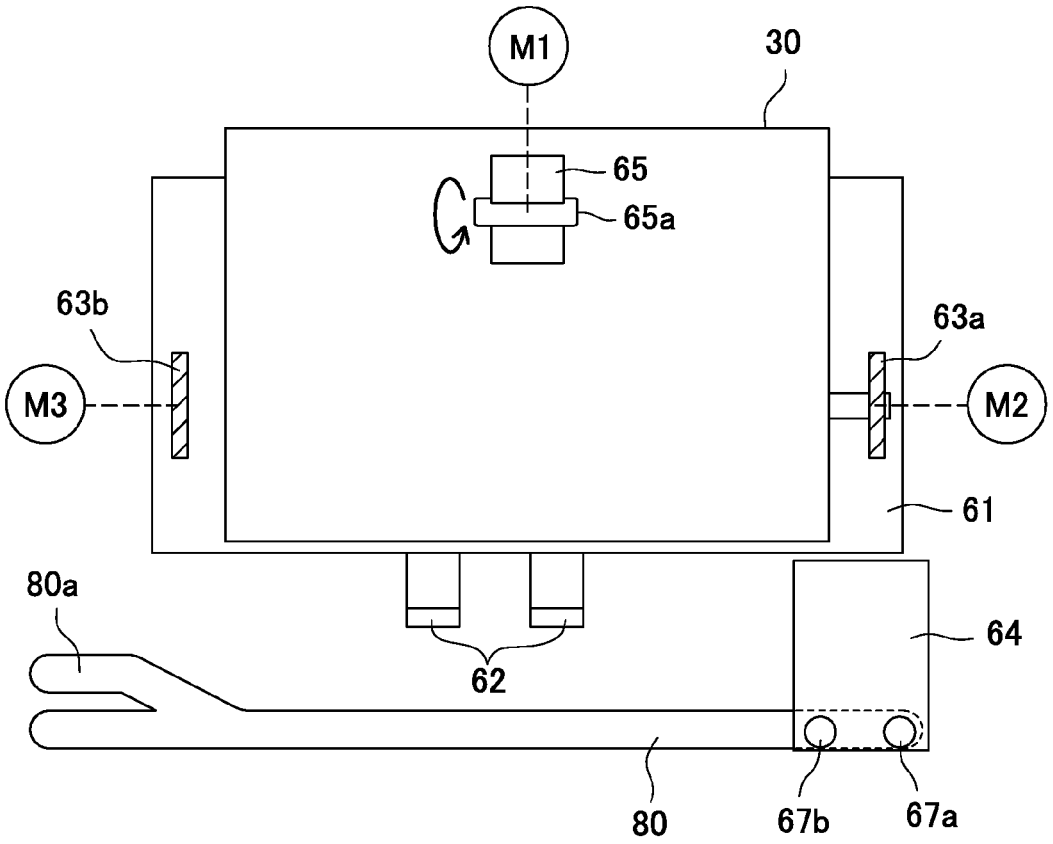
FIG. 2 is a plan view showing a configuration of a binding part of the sheet post-processing apparatus and a state in which a sheet is discharged onto a processing tray.
Figure 3:
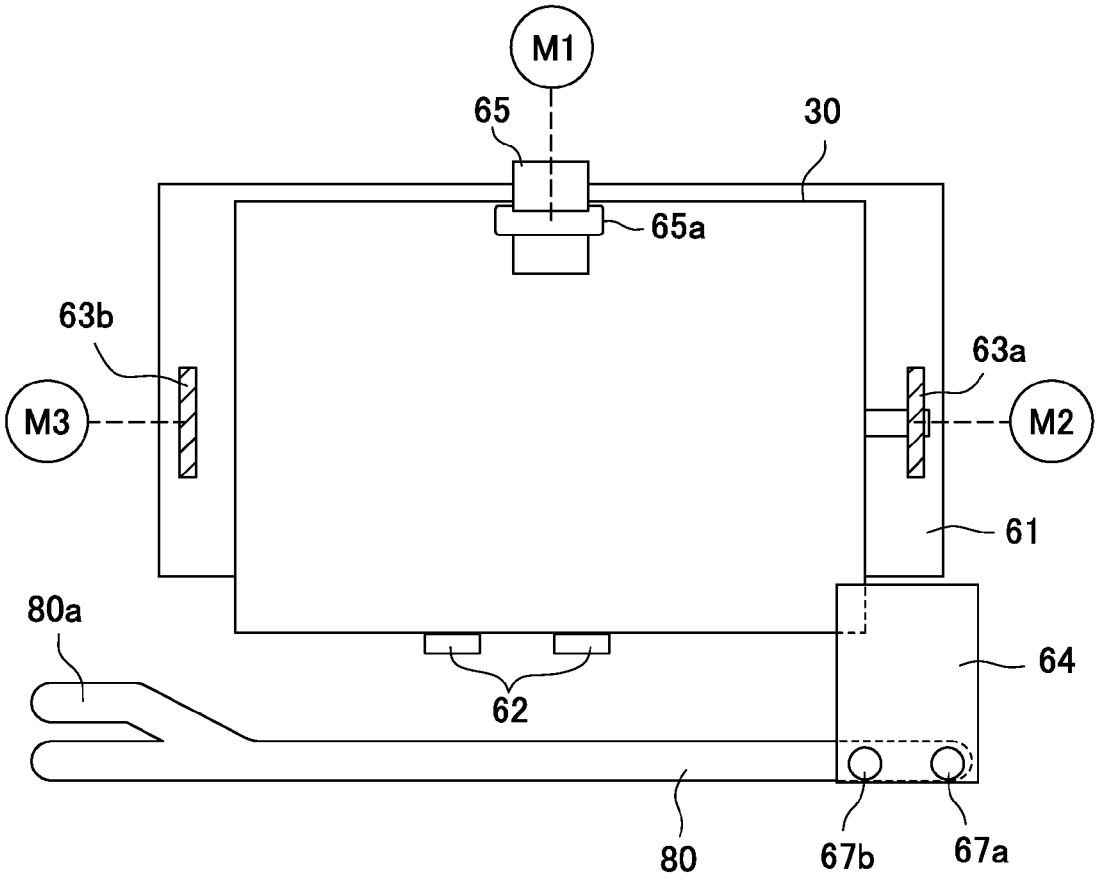
FIG. 3 is a plan view showing a state in which a trailing edge of the sheet is aligned on the processing tray.
Figure 4:
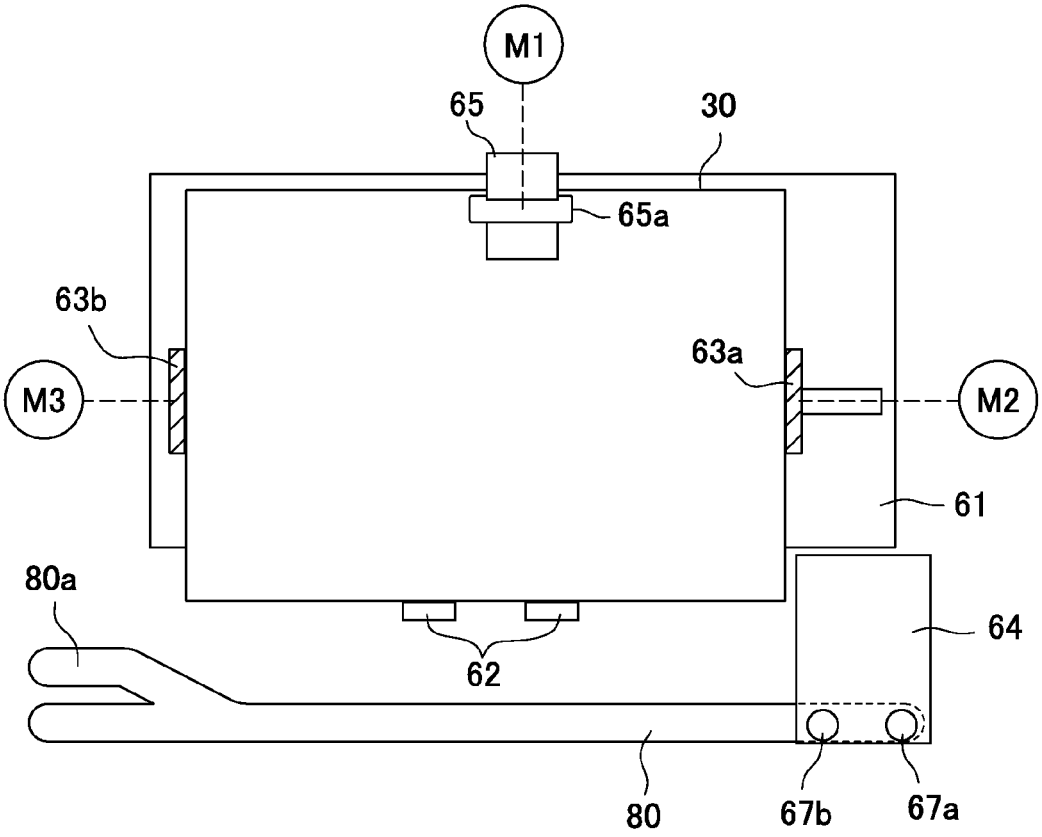
FIG. 4 is a plan view showing a state in which side ends of the sheet are aligned on the processing tray.

FIG. 2 is a plan view showing a configuration of the binding part 50 of the sheet post-processing apparatus and a state of a sheet in the binding part 50. FIGS. 3 and 4 are plan views showing the state of the sheet in the binding part 50. As shown in FIG. 2, the binding part 50 includes a processing tray 61, trailing edge regulation plates 62, a pair of side regulation plates (first and second side regulation plates) 63*a* and 63*b*, a binding unit 64, a paddle 65, and a discharge belt 66 (see FIG. 1). Sheets 30 are stacked on the processing tray 61. The trailing edge regulation plates 62 align the trailing edges of the sheets on the processing tray 61. The side regulation plates 63*a* and 63*b* align both ends of the sheets 30 in the width direction. The binding unit 64 binds the sheets 30 aligned on the processing tray 61. The paddle 65 is arranged above the processing tray 61. The discharge belt 66 discharges the sheets on the processing tray 61 to the second stacking tray 57.

The paddle 65 is rotatably supported by a rotating shaft 65*a*. The paddle 65 is driven by a paddle driving motor M1 to rotate in the direction of the arrow in the diagram, and thereby pushes out the sheets 30 toward the trailing edge regulation plates 62. The discharge belt 66 is stretched between a pair of pulleys. The discharge belt 66 is driven by a discharge motor M5 to discharge the sheets on the processing tray 61 to the second stacking tray 57.

The side regulation plate 63*a* and 63*b* are provided on the left and right side ends of the processing tray 61, with the sheets 30 therebetween. The side regulation plate 63*a* is connected to a first shift motor M2 via a rack mechanism (not shown). The side regulation plate 63*b* is connected to a second shift motor M3 via a rack mechanism. The side regulation plates 63*a* and 63*b* are thus moved to reciprocate in the width direction of the sheets 30 by forward and backward rotations of the first and second shift motors M2 and M3.

The sheets sequentially discharged from the first and second conveyance paths 53 and 54 onto the processing tray 61 are aligned one by one by the trailing edge regulation plates 62, the side regulation plates 63*a* and 63*b*, and the paddle 65. The aligned sheets are positioned to a binding position of the binding unit 64 which is provided at a corner on one side of the processing tray 61.

The positioning will be described in detail. A sheet 30 carried out to the processing tray 61 is moved toward the trailing edge regulation plates 62 by the rotation of the paddle 65 as shown in FIG. 2. The trailing edge of the sheet is abutted against the trailing edge regulation plates 62, whereby the trailing edge of the sheet 30 is aligned. With the trailing edge of the sheet aligned, the first shift motor M2 is driven to move the side regulation plate 63*a* toward the other side regulation plate 63*b* as shown in FIG. 3. The side regulation plate 63*a* makes contact with one end of the sheet 30 and moves the sheet 30 toward the side regulation plate 63*b*. The other end of the sheet 30 then comes into contact with the side regulation plate 63*b*. As shown in FIG. 4, both sides of the sheet are thereby aligned and the sheet 30 is positioned. That is, in the present embodiment, the sheet is aligned by driving the first shift motor M2. The first shift motor M2 stops if the one side regulation plate 63*a* is moved to a position at which the other end of the sheet 30 comes into contact with the side regulation plate 63*b*.

Figure 5B:
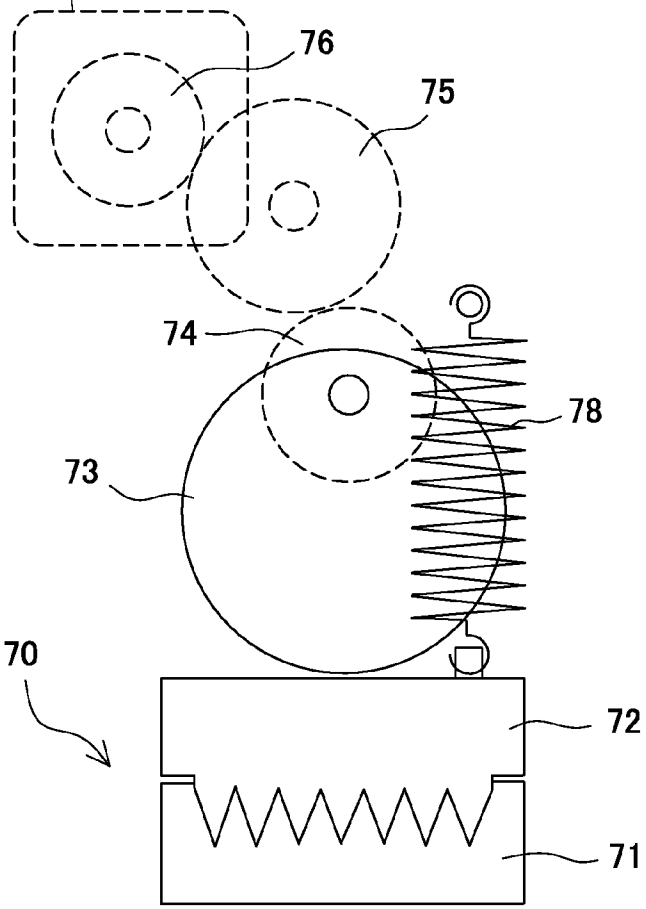
FIGS. 5A and 5B are configuration diagrams showing a driving mechanism of a binding tool in a binding unit of the sheet post-processing apparatus.
Figure 5A:
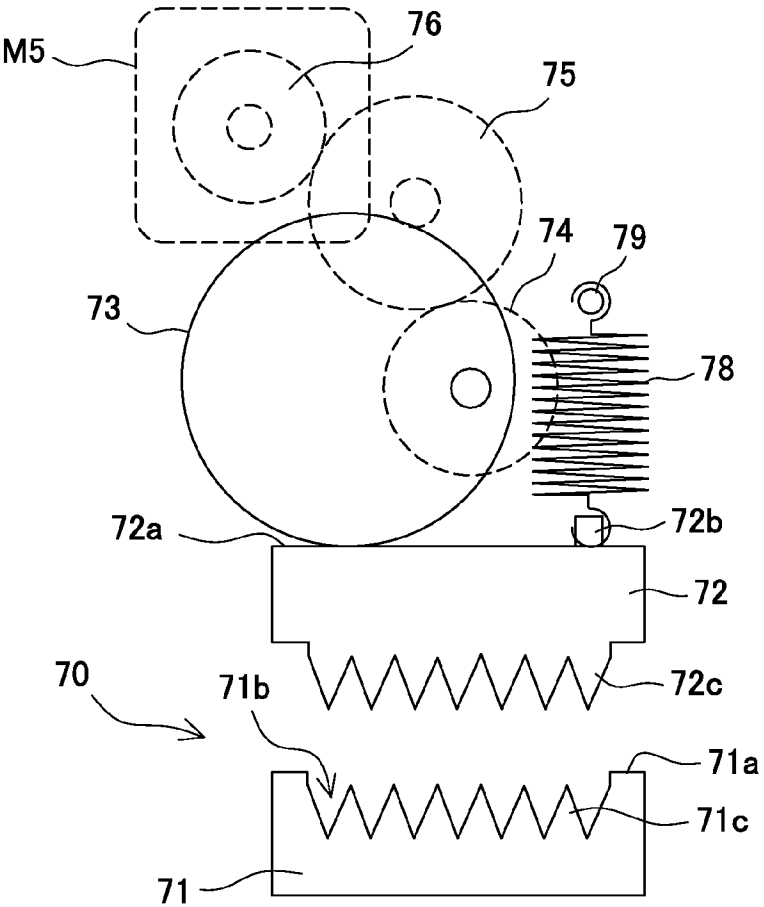

FIGS. 5A and 5B are configuration diagrams showing a driving mechanism for operating a binding tool 70 in the binding unit 64. The binding unit 64 includes the binding tool 70 serving as a binding section for applying binding to sheets. As shown in FIGS. 5A and 5B, the binding tool 70 includes a lower tooth member 71 and an upper tooth member 72. The lower tooth member 71 is arranged on a sheet placing surface side of the processing tray 61. The upper tooth member 72 is opposed to the lower tooth member 71. The pair of tooth molds sandwiches and presses a sheet bundle therebetween. The sheets are thereby deformed and fibers of the sheets are entangled with each other to apply binding (crimp binding) to the sheets.

The lower tooth member 71 of the binding tool 70 is provided so that its upper surface 71*a* is flush with the sheet placing surface of the processing tray 61. Binding teeth 71*c* of recessed and protruded shape are formed on an inner bottom of a groove portion 71*b*. Binding teeth 72*c* of recessed and protruded shape to mesh with the binding teeth 71*c* of the lower tooth member 71 are formed on the bottom of the upper tooth member 72.

An eccentric cam 73 is in contact with a top surface 72*a* of the upper tooth member 72. Rotation of the eccentric cam 73 moves the upper tooth member 72 downward so that the binding teeth 72*c* of the upper tooth member 72 mesh with the binding teeth 71*c* of the lower tooth member 71. The sheets between the binding teeth 72*c* of the upper tooth member 72 and the binding teeth 71*c* of the lower tooth member 71 are thereby pressed to expose fibers on the surfaces of the sheets, and the fibers of the sheets are entangled with and fastened to each other.

The eccentric cam 73 is connected to a binding motor M4 via drive transmission gears 74, 75, and 76. The binding motor M4 is driven to rotate the eccentric cam 73. The eccentric cam 73 is configured so that if the eccentric cam 73 is rotated by a half turn, the upper tooth member 72 moves from a standby position to a meshing position and moves to the standby position again. That is, the binding tool 70 presses and binds the sheets as the eccentric cam 73 is rotated by a half turn.

A tension spring 78 is provided to move the upper tooth member 72 to the standby position. One end of the tension spring 78 is attached to an attachment tab 72*b* formed on the upper surface 72*a* of the upper tooth member 72. The other end of the tension spring 78 is attached to an attachment pin 79 which is provided on a side plate (not shown) of the apparatus. As shown in FIG. 5A, the tension spring 78 thus pulls up and moves the upper tooth member 72 to the standby position according to the rotation of the eccentric cam 73. As shown in FIG. 5B, if the eccentric cam 73 is rotated further, the eccentric cam 73 moves the upper tooth member 72 to the meshing position against the pulling force of the tension spring 78.

As described above, the binding unit 64 integrally includes the binding tool 70, the eccentric cam 73, the drive transmission gears 74, 75, and 76, the driving motor M4, and the tension spring 78. The binding unit 64 is configured to move along one side of the sheets on the processing tray 61 according to a guide groove 80 provided near the end portion of the processing tray 61.

Specifically, a pair of slide pins 67*a* and 67*b* is provided in parallel on the end portion of the binding unit 64. The slide pins 67*a* and 67*b* are engaged with the guide groove 80 which is formed in a unit frame along the width direction of the sheets. A unit moving mechanism 69 shown in FIG. 6, including a rack mechanism or a belt mechanism, enables the binding unit 64 to reciprocate along the guide groove 80. The slide pin 67*a* serves as a rotation fulcrum about which the binding unit 64 swings. The guide groove 80 is formed to branch out at an end, and configured so that the slide pin 67*b* is guided into a branch part 80*a*. If the slide pin 67*b* is guided into the branch part 80*a*, the binding unit 64 swings with the slide pin 67*a* as the fulcrum, and changes its orientation to be oblique to the one side of the sheets.

The binding tool 70 is configured to be capable of reciprocation by itself in a direction orthogonal to the width direction, aside from movement by the binding unit 64 in the width direction of the sheets. The binding tool 70 includes a binding tool moving mechanism 49 (see FIG. 6) for reciprocating the upper tooth member 72 and the lower tooth member 71 in that direction. Although a specific configuration of the binding tool moving mechanism 49 is not shown in the drawings, the binding tool moving mechanism 49 includes a publicly-known endless belt or rack mechanism.

Figure 6:
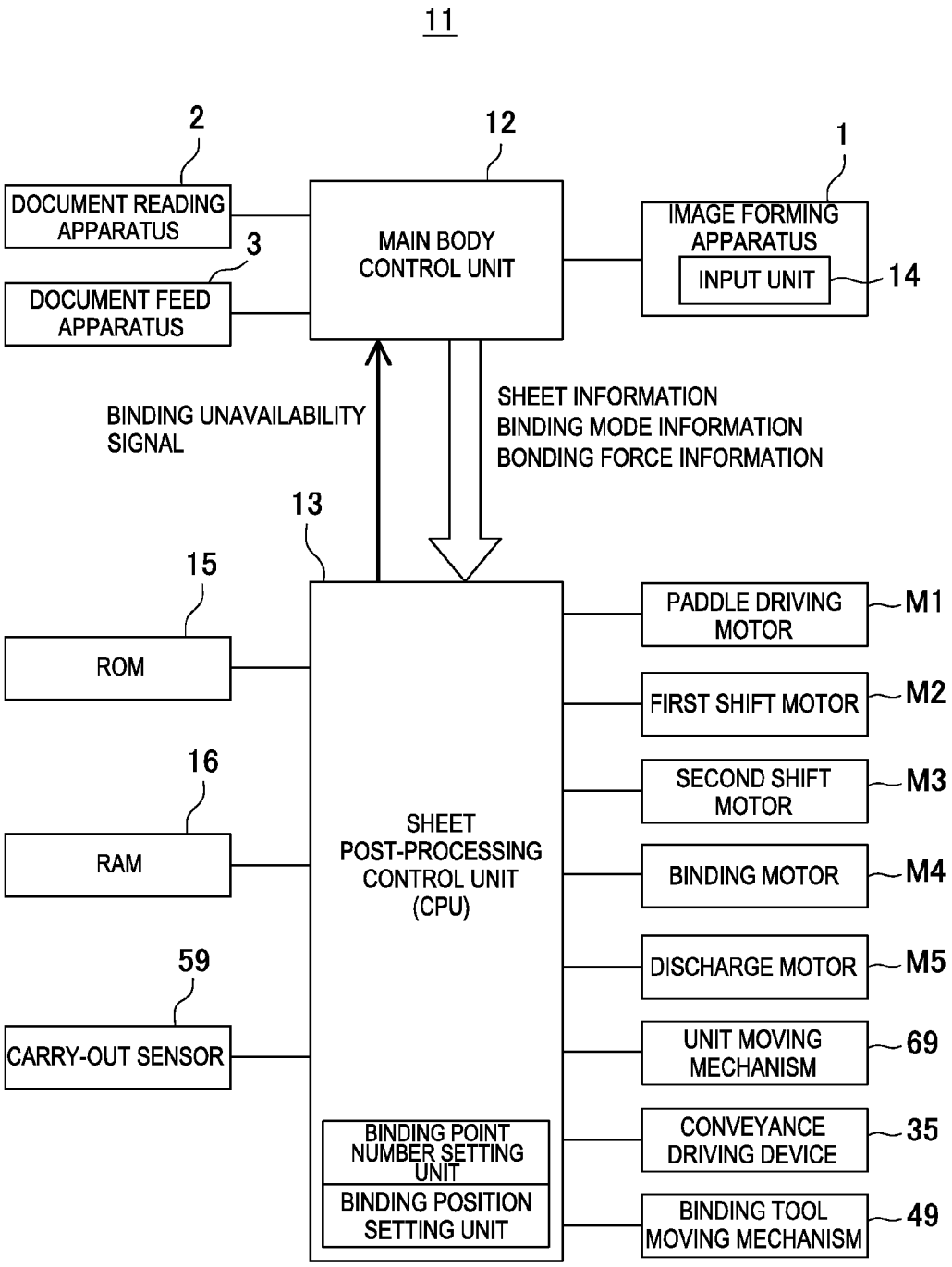
FIG. 6 is a block diagram showing a control configuration of the image forming system including the sheet post-processing apparatus.

FIG. 6 is a block diagram showing a control system of the image forming system. A configuration of a control apparatus 11*a* of the image forming system will be described with reference to FIG. 6. The control apparatus 11*a* includes a main body control unit 12*a* and a sheet post-processing control unit 13*a*. The main body control unit 12*a* controls operations of the image forming apparatus 1, the document reading apparatus 2, and the document feed apparatus 3. The sheet post-processing control unit 13*a* controls the sheet post-processing apparatus 4.

The image forming apparatus 1 includes an input unit 14*a* which includes an operation panel and is arranged on a front side where the user of the image forming system is positioned. The user of the image forming system inputs various types of information, including image finishing specifications, size information about sheets to be printed, binding mode information, and bonding force information, from the operation panel of the input unit 14*a*.

The main body control unit 12*a* controls the document reading apparatus 2 and the document feed apparatus 3 according to the contents input to the input unit 14*a*. The main body control unit 12*a* then controls the image forming apparatus 1 to print images of documents read by the document reading apparatus 2 on sheets and send the sheets to the sheet post-processing apparatus 4 in succession. In addition, the main body control unit 12*a* outputs sheet information indicating the size, type, and the number of sheets to be printed, the binding mode information, and the bonding force information to the sheet post-processing control unit 13*a* based on the contents input to the input unit 14*a*. The sheet post-processing control unit 13*a* outputs a binding unavailability signal and other signals indicating the state of the sheet post-processing apparatus 4 to the main body control unit 12*a*.

The sheet post-processing control unit 13*a* controls a post-processing operation which is performed on the image-formed sheets delivered from the image forming apparatus 1. The sheet post-processing control unit 13*a* includes a CPU, and controls an operation of the entire sheet post-processing apparatus 4 by executing a control program stored in a ROM 15*a*. The sheet post-processing control unit 13*a* is therefore connected with the binding motor M4, the paddle driving motor M1, the first and second shift motors M2 and M3, the binding tool moving mechanism 49, the unit moving mechanism 69, and a conveyance driving device 35. The binding motor M4 drives the eccentric cam 73 of the binding tool 70. The paddle driving motor M1 drives the paddle 65 to rotate. The conveyance driving device 35 includes a plurality of driving motors for driving the conveyance roller pairs arranged on the conveyance paths 53, 54, and 55, and the discharge roller pair 60.

Figure 7:
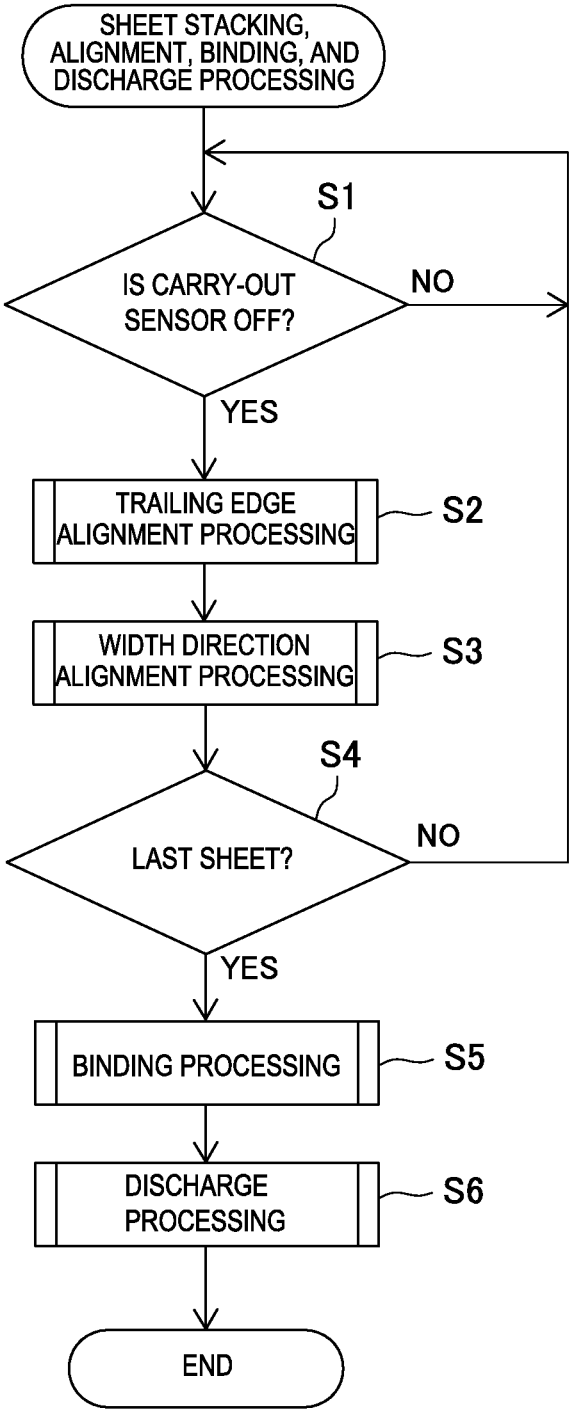
FIG. 7 is an operation flowchart showing sheet stacking, alignment, binding, and discharge processing in the sheet post-processing apparatus.

FIG. 7 is an operation flowchart showing an operation for sheet stacking, alignment, binding, and discharge processing. The sheet post-processing control unit 13*a* executes the sheet stacking, alignment, binding, and discharge processing as shown in FIG. 7. The sheet post-processing control unit 13*a* initially determines by using the carry-out sensor 59 whether a sheet is carried out onto the processing tray 61 (step S1). The carry-out sensor 59 turns on if a sheet carried out to the discharge port 58 is detected. If the sheet is discharged from the discharge port 58 to the processing tray 61, the trailing edge of the sheet passes the detection position and the carry-out sensor 59 turns off. If the carry-out sensor 59 switches from on to off, then the sheet post-processing control unit 13*a* determines that a sheet is carried out onto the processing tray 61.

The sheet post-processing control unit 13*a* then controls the driving of the paddle driving motor M1 to rotate the paddle 65 and perform trailing edge alignment processing on the sheet discharged to the processing tray 61 (step S2). As shown in FIG. 2, the sheet 30 is moved by the paddle 65 in a direction opposite to the sheet carry-out direction. As shown in FIG. 3, the trailing edge of the sheet 30 is thereby abutted against and aligned by the trailing edge regulation plates 62.

After the alignment of the trailing edge of the sheet 30 ends, the sheet post-processing control unit 13*a* performs alignment processing in the width direction (step S3). In this alignment processing, the sheet post-processing control unit 13*a* moves the first side regulation plate 63*a* toward the second side regulation plate 63*b*. One end of the sheet 30 in the width direction is thus pushed by the first side regulation plate 63*a*, and the sheet 30 moves toward the second side regulation plate 63*b*. The other end of the sheet 30 in the width direction then comes into contact with the second side regulation plate 63*b*. Both ends of the sheet 30 are thereby aligned in the width direction as shown in FIG. 4.

The distance by which the sheet post-processing control unit 13*a* moves the first side regulation plate 63*a* toward the second side regulation plate 63*b* is determined according to the sheet size. More specifically, the sheet post-processing control unit 13*a* moves the first side regulation plate 63*a* to a position at which the distance between the side regulation plates 63*a* and 63*b* is slightly shorter than the length of the sheet 30 in the width direction. The sheet size is included in the sheet information from the main body control unit 12*a*.

Next, the sheet post-processing control unit 13*a* determines whether the sheet 30 positioned by the alignment of the trailing edge and the width direction on the processing tray 61 is the last sheet (step S4). If the sheet 30 is not determined to be the last one, the sheet post-processing control unit 13*a* returns to step S1 and repeats the processing of step S2 and subsequent steps. The sheets 30 delivered from the discharge port 58 in succession are thus accumulated on the processing tray 61. Information about the last sheet is included in the sheet information transmitted from the main body control unit 12*a* sheet by sheet. Whether the sheet 30 is the last one is determined based on the sheet information. If the sheet 30 is determined to be the last one, the binding unit 64 performs binding processing on the sheets 30 (step S5). The sheets 30 binding-processed on the processing tray 61 are then discharged to the second stacking tray 57 (step S6).

Figure 8:
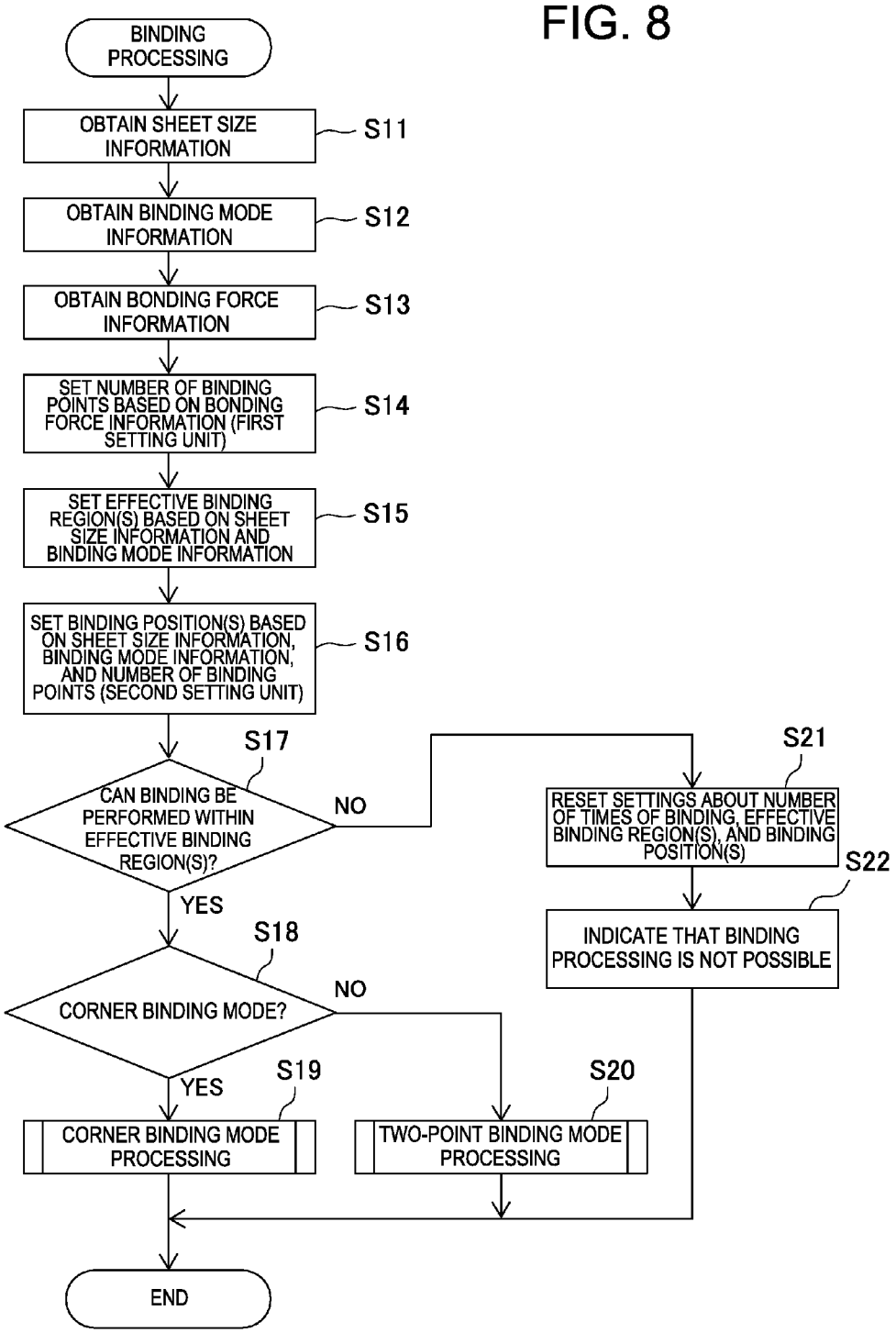
FIG. 8 is an operation flowchart showing an operation of the binding processing of the sheet post-processing apparatus.

FIG. 8 is an operation flowchart showing details of the binding processing (step S5) by the sheet post-processing apparatus 4. In the binding processing, the sheet post-processing control unit 13*a* obtains various types of information, including the sheet size information, the binding mode information, and the bonding force information, from the main body control unit 12*a* (steps S11 to S13). The binding mode information indicates the binding position(s) of a sheet bundle. The binding mode information is input to the input unit 14*a* by the user of the image forming system.

Binding modes in the present embodiment include a "corner binding mode" in which the sheets 30 are bound at a corner and a "two-point binding mode" in which the sheets 30 are bound at two points along a side. The binding modes are specified by way of operation buttons provided on the input unit 14*a*. The bonding force information is also an input item to be input to the input unit 14*a* by the user. Binding forces for the crimp binding, "high", "normal", and "low", are specified by way of operation buttons provided on the input unit 14*a*. If the user intends to perform temporary binding by which bound sheets can be easily exfoliated afterward, "low" is selected. In the "corner binding mode" according to the present embodiment, "oblique binding" for applying binding in a direction crossing two sides of a corner of the sheets is performed on the corner of the sheets. In the "two-point binding mode", "parallel binding" for applying binding in a direction parallel to one side of the sheets 30 is performed on two points along the one side of the sheets 30.

Obtaining such pieces of information, the sheet post-processing control unit 13*a* makes various settings about binding. Initially, the sheet post-processing control unit 13*a* sets the number of binding points based on the bonding force information (binding point number setting unit/first setting unit) (step S14). For example, if the user selects "high" on the operation panel of the input unit 14*a*, the number of binding points is set to "3". If "normal" is selected, the number of binding points is set to "2". If "low" is selected, the number of binding points is set to "1". The sheet post-processing control unit 13*a* thus has a function as a setting unit for setting the number of binding points of the sheets 30.

The sheet post-processing control unit 13*a* then sets a region or regions available for binding (effective binding region(s)) based on the sheet size information and the binding mode information (step S15). In the case of corner binding, an effective binding region is set in a normally-set margin portion at a corner of the sheets 30. In the case of two-point binding, effective binding regions are set in a normally-set margin portion on one side of the sheets 30.

Next, the sheet post-processing control unit 13*a* sets a binding position(s) based on the sheet size information, the binding mode information, and the number of binding points (binding position setting unit/second setting unit) (step S16). To set the binding position(s), a data table is previously set in the program. The sheet post-processing control unit 13*a* extracts and sets suitable data from the table based on the sheet size, the binding mode, and the number of binding points. It will be understood that the post-processing control unit 13*a* may calculate the binding position(s) from the sheet size, the binding mode, and the number of binding points each time without using the previously-stored data.

In the present embodiment, the binding position(s) is/are evenly set within each effective binding region. More specifically, if the number of binding points is one, the binding position is set at the center position in the effective binding region. If the number of binding points is two, the effective binding region is divided into two equal blocks, and the binding positions are set at the centers of the respective blocks. If the number of binding points is three, the binding positions are set at the centers of three equal blocks.

Figure 9A:
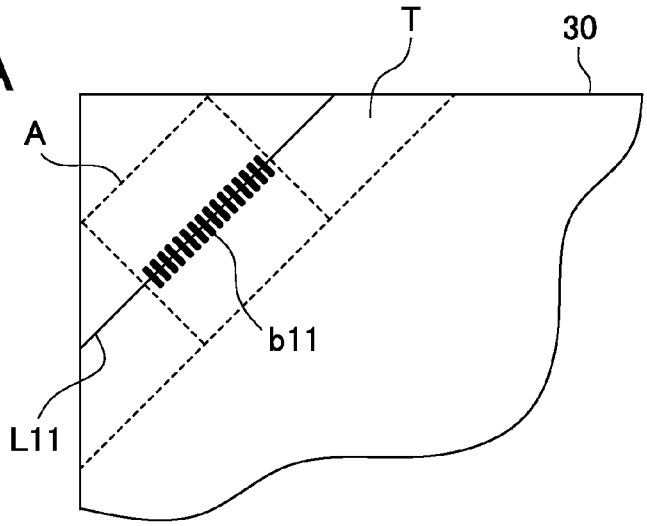
FIGS. 9A, 9B, and 9C are plan views showing binding positions according to the number of binding points in the case of corner binding.
Figure 9B:
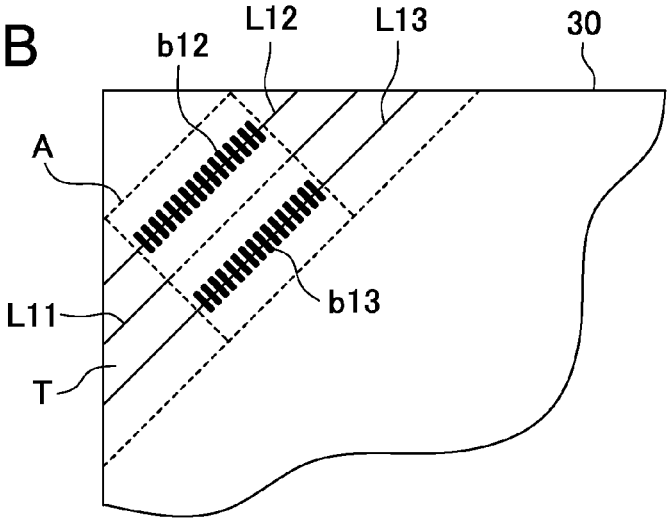
Figure 9C:
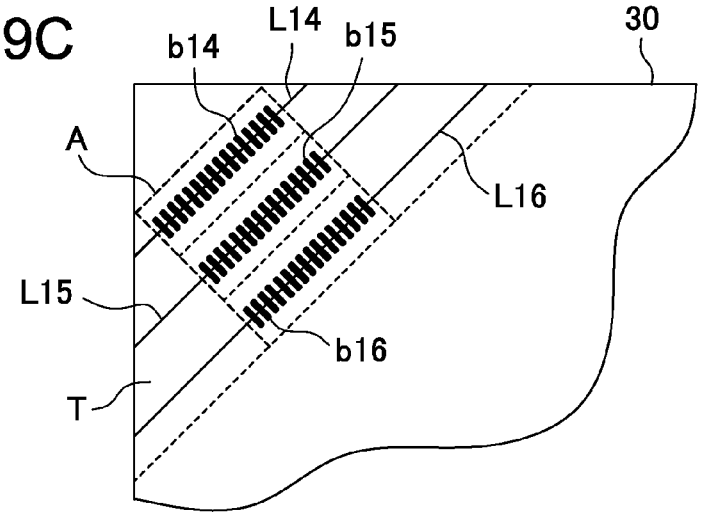

FIGS. 9A to 9C show binding positions according to the number of binding points in the case of corner binding. In corner binding, an effective binding region A is a substantially square range falling within a triangular area T at the corner of the sheets 30. In such an effective binding area A of substantially square shape, if the number of binding points is one, as shown in FIG. 9A, a binding position b11 is set on a line L11 that connects the centers of a pair of opposite sides toward the corner of the sheets in the effective binding region A. If the number of binding points is two, as shown in FIG. 9B, the square is divided into two equal rectangular blocks by the line L11, and binding positions b12 and b13 are set on center lines L12 and L13 of the respective blocks parallel to the line L11. If the number of binding points is three, as shown in FIG. 9C, the effective binding region A is divided into three equal rectangular blocks, and binding positions b14, b15, and b16 are set on center lines L14, L15, and L16 of the respective blocks. The first position to apply binding to thus varies with the number of binding points on the sheets 30. The pitch between the binding positions also varies with the number of binding points.

Figure 10A:
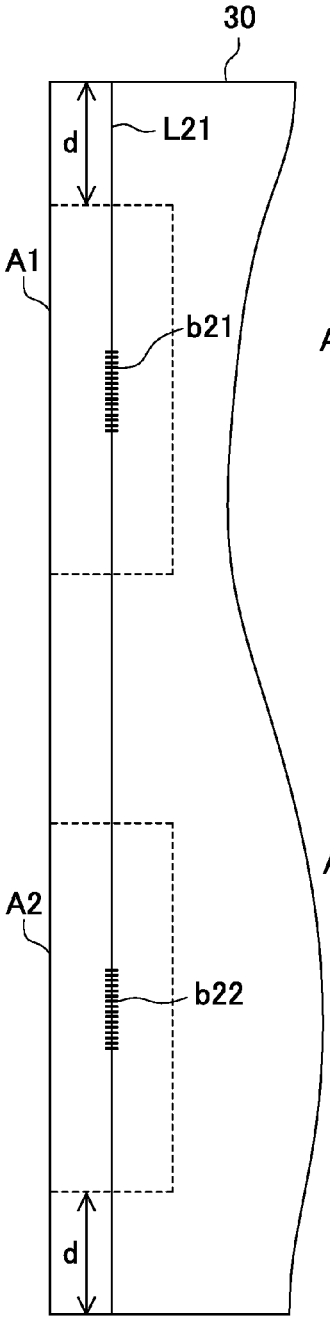
FIGS. 10A, 10B, and 10C are plan views showing binding positions according to the number of binding points in the case of two-point binding.
Figure 10B:
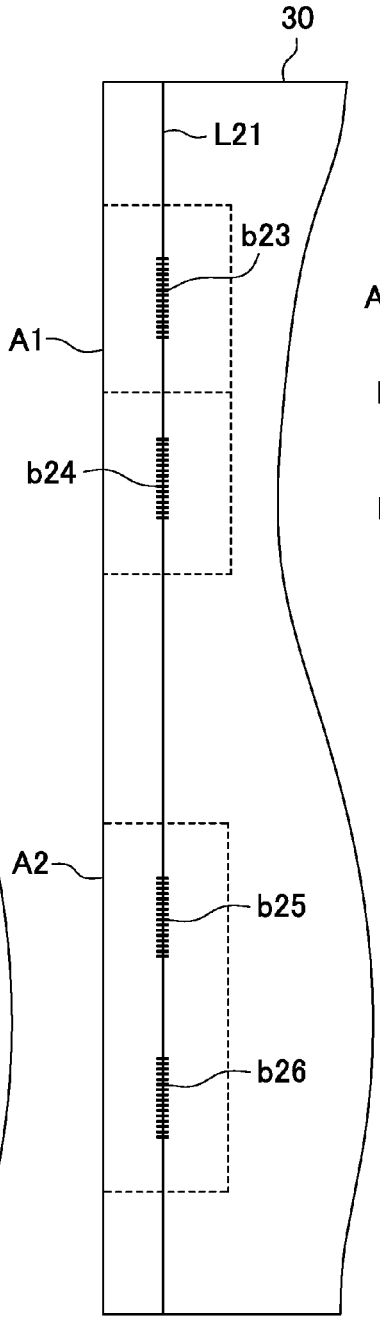
Figure 10C:
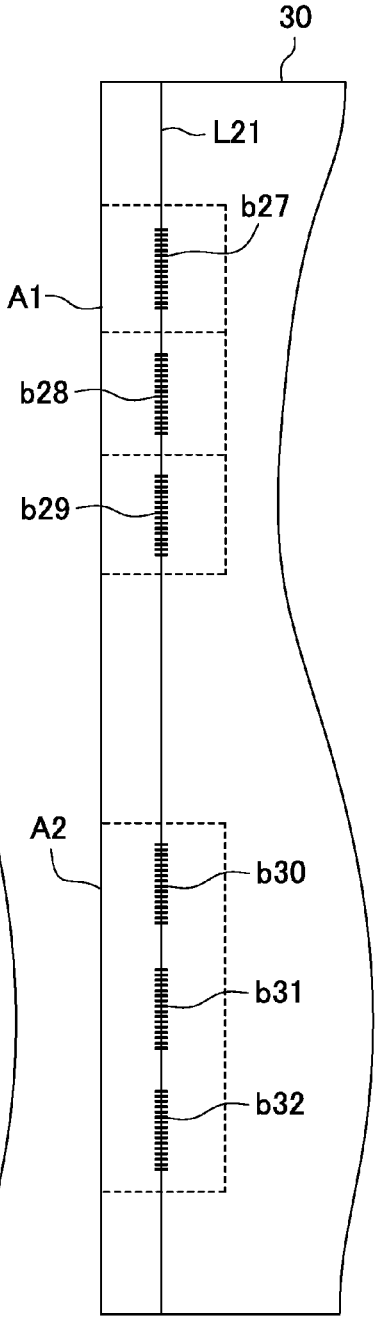

FIGS. 10A to 10C show binding positions according to the number of binding points in the case of two-point binding. In two-point binding, effective binding regions A1 and A2 of the same rectangular shape are set in a margin portion of one side of the sheets 30. The effective binding regions A1 and A2 are located at equal distances d from the top and bottom sides of the sheets 30, respectively. Binding positions are set on a line L21 that connects the centers of the opposed sides orthogonal to the one side of the sheets 30 in the respective effective binding regions A1 and A2. If the number of binding points is one, binding positions b21 and b22 are set at the centers of respective line segments parallel to the one side of the sheets 30 in the rectangular effective binding regions A1 and A2. If the number of binding points is two, the effective binding regions A1 and A2 are each divided into two blocks adjoining along the side of the sheets 30, and binding positions b23, b24, b25, and b26 are set at the centers of respective line segments in the divided blocks. If the number of binding points is three, the effective binding regions A1 and A2 are each divided into three blocks adjoining along the side of the sheets 30, and binding positions b27, b28, b29, b30, b31, and b32 are set at the centers of respective line segments in the divided blocks. In the case of two-point binding, like corner binding, the first position to apply binding to thus varies with the number of binding points on the sheets 30. A pitch h between the binding positions also varies with the number of binding points.

In setting the binding position(s), the sheet post-processing control unit 13*a* determines whether the set position(s) is/are available for binding (step S17). If any of the set binding position(s) is unavailable for binding, the sheet post-processing control unit 13*a* resets all the settings of the binding position(s) (step S21). The sheet post-processing control unit 13*a* then outputs an error signal to the main body control unit 12*a* to notify the main body control unit 12*a* that the binding processing is not possible (step S22). The main body control unit 12*a* then informs the user that the binding mode and the number of binding points input from the input unit 14*a* are not executable. The state in which binding is not possible refers to when crimps overlap. Crimps can overlap if the sheet size is small or if the number of binding points is large.

If the binding processing is possible, the sheet post-processing control unit 13*a* performs either corner binding mode processing or two-point binding mode processing according to the selected binding mode (steps S18, S19 and S20).

Figure 12:
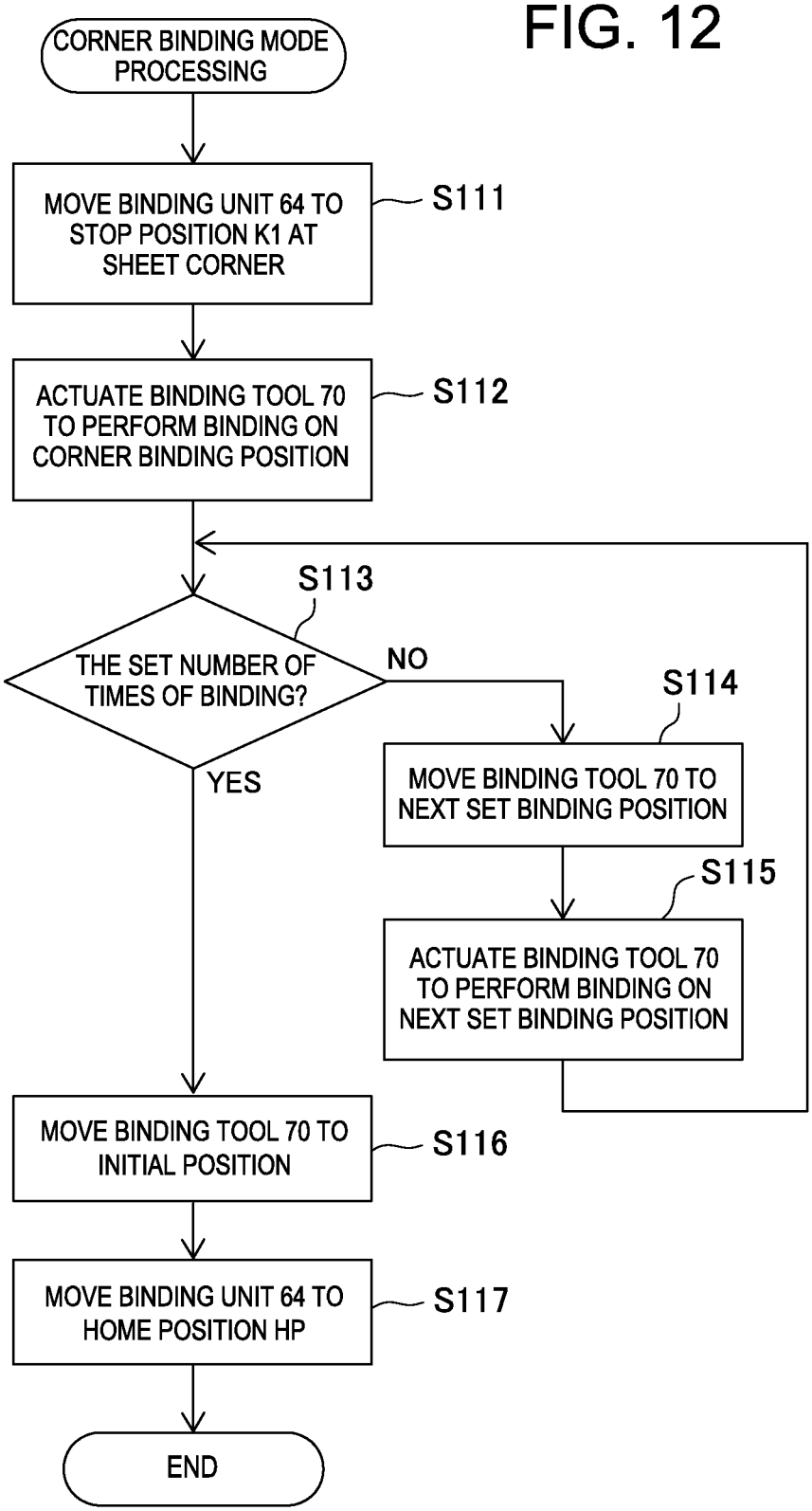
FIG. 12 is a flowchart showing a binding operation in corner binding mode processing of the sheet post-processing apparatus.
Figure 13A:
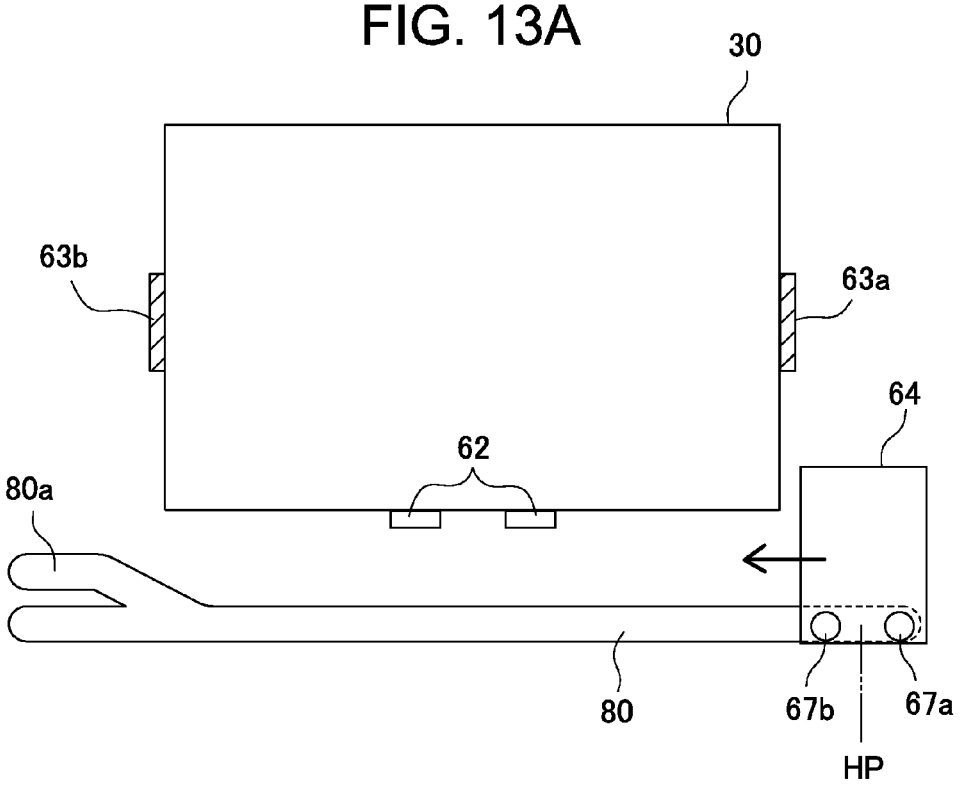
FIGS. 13A and 13B are schematic diagrams showing an operation of the binding unit in the corner binding mode processing.
Figure 13B:
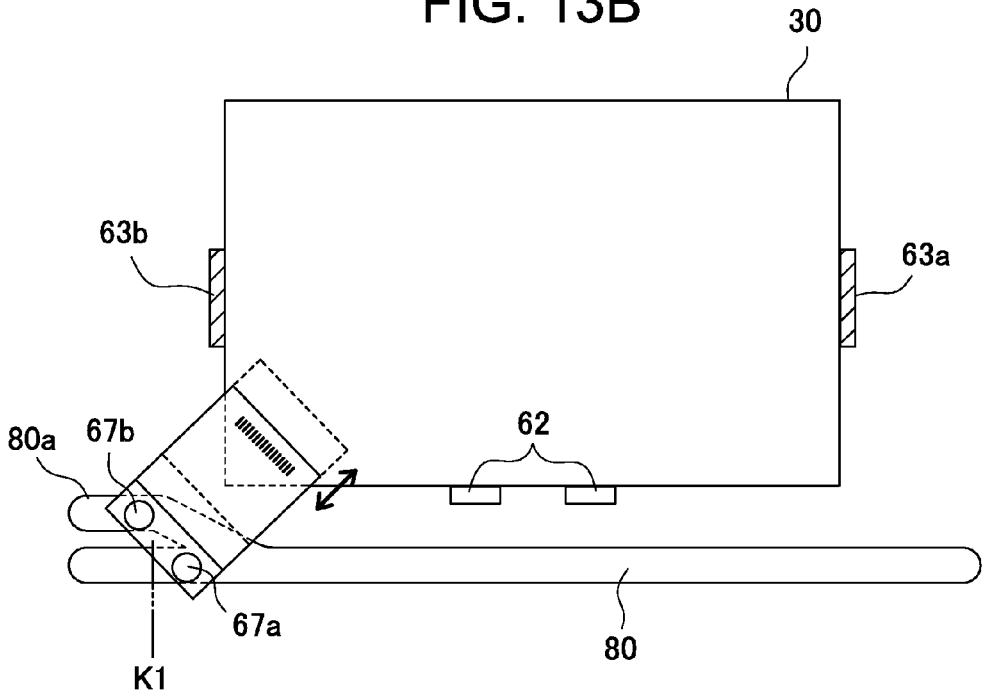

FIG. 12 is an operation flowchart showing the corner binding mode processing. FIGS. 13A and 13B are schematic diagrams showing an operation of the binding unit in the corner binding mode processing. If the corner binding mode is selected, the sheet post-processing control unit 13*a* controls the unit moving mechanism 69 (see FIG. 6) to move the binding unit 64 located at a home position HP in a direction parallel to one side of the sheets 30 (step S111) (see FIG. 13A). The sheet post-processing control unit 13*a* then stops the binding unit 64 at a predetermined stop position K1 at the end of the one side of the sheets 30 (see FIG. 13B). Here, the binding unit 64 at the stop position K1 swings and is located at the corner of the sheets 30, with the slide pin 67*b* in the branch part 80*a*.

Figure 14:
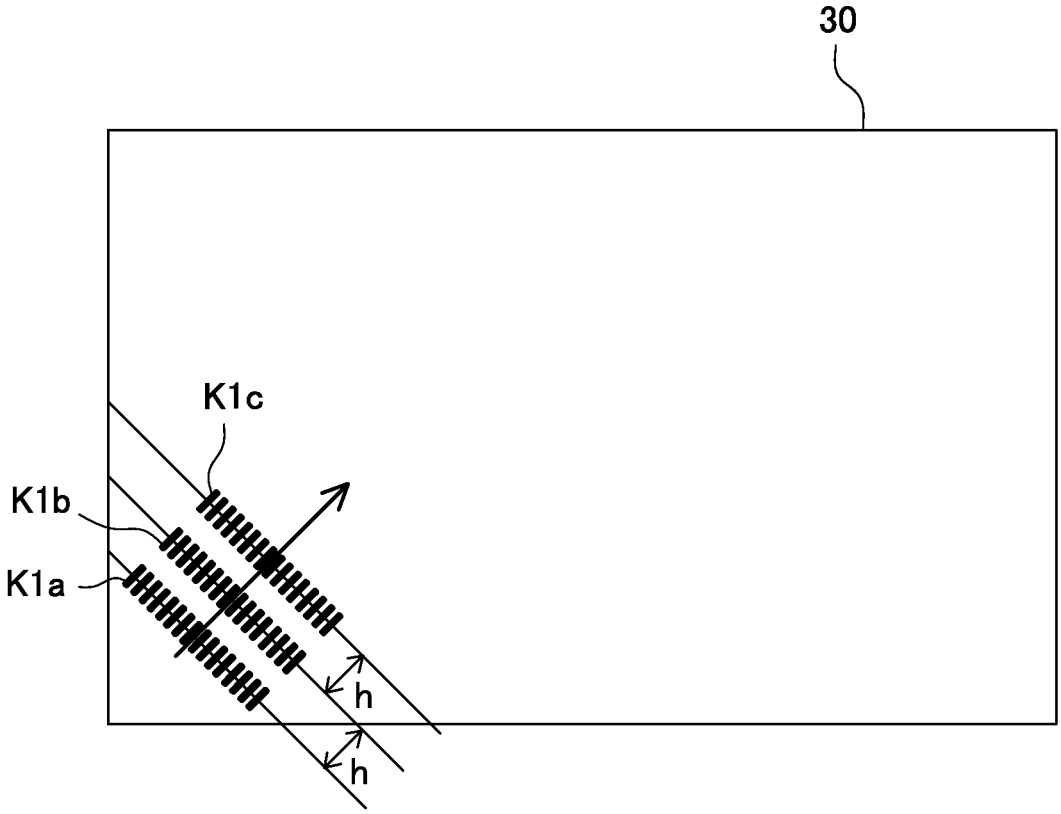
FIG. 14 is a plan view showing binding traces when binding is applied to a plurality of binding positions in the corner binding mode processing.

The sheet post-processing control unit 13*a* then controls the driving of the binding motor M4 to actuate the binding tool 70 and apply binding to a set corner binding position (step S112). If the binding at the set binding position ends, the sheet post-processing control unit 13*a* determines whether binding has been completed as many times as the set number of binding points (step S113). If binding has not been completed as many time as the set number of binding points (set number of times of binding), the sheet post-processing control unit 13*a* moves the binding tool 70 by a pitch h toward the diagonal center of the sheets 30, with the binding unit 64 stopped at the predetermined stop position K1 (step S114). The sheet post-processing control unit 13*a* thereby moves the binding tool 70 to the next binding position, and actuates the binding tool 70 to apply binding (step S115). If the set number of binding points is not reached, the sheet post-processing control unit 13*a* further moves the binding tool 70 to the next set binding position and actuates the binding tool 70. In such a manner, as shown in FIG. 14, crimps K1*a*, K1*b*, and K1*c* as many as the set number of binding points are formed on the sheets 30.

As described above, in the case of the corner binding mode, the sheet post-processing control unit 13*a* controls the binding tool 70 to apply the binding processing to a plurality of binding points along the diagonal direction toward the center of the sheets 30. If the binding positions are at the corner of the sheets 30, the sheet post-processing control unit 13*a* thus applies the binding processing along the diagonal direction of the sheets 30.

If the set number of times of binding is reached ("YES" in step S113), the sheet post-processing control unit 13*a* returns the binding tool 70 to K1 which is the initial position (step S116). The sheet post-processing control unit 13*a* then controls the unit moving mechanism 69 to return the binding unit 64 to the home position HP, and ends the corner binding mode processing (step S117).

Figure 15:
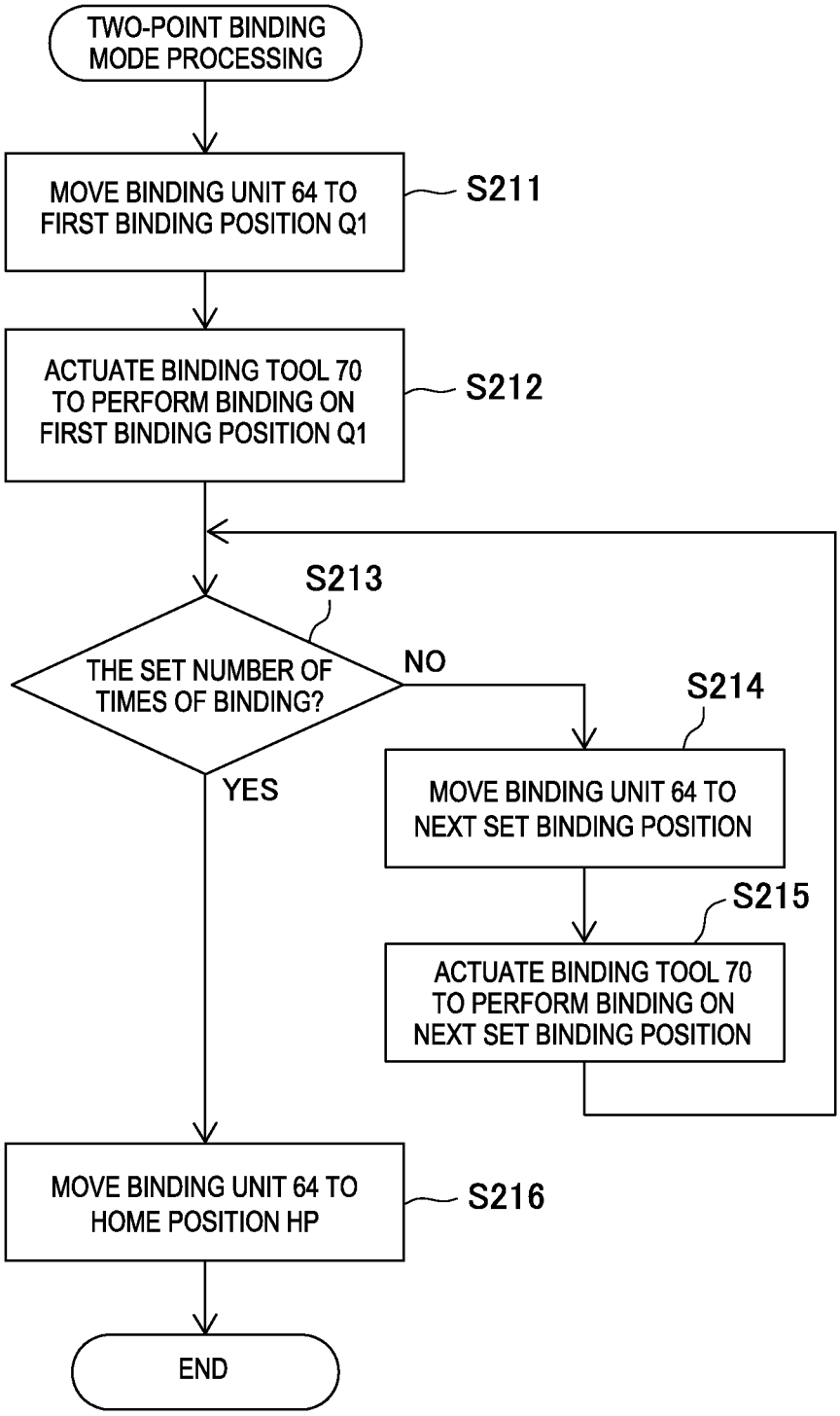
FIG. 15 is a flowchart showing a binding operation in two-point binding mode processing of the sheet post-processing apparatus.
Figure 16A:
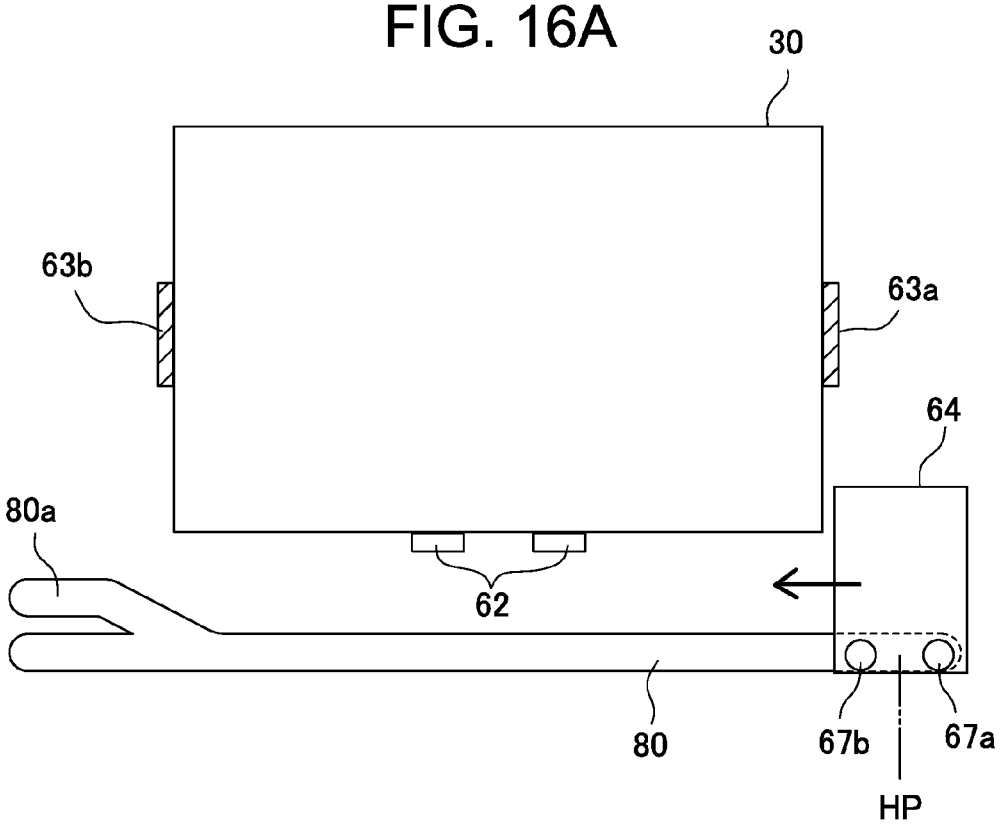
FIGS. 16A and 16B are schematic diagrams showing an operation of the binding unit in the two-point binding mode processing.
Figure 17:
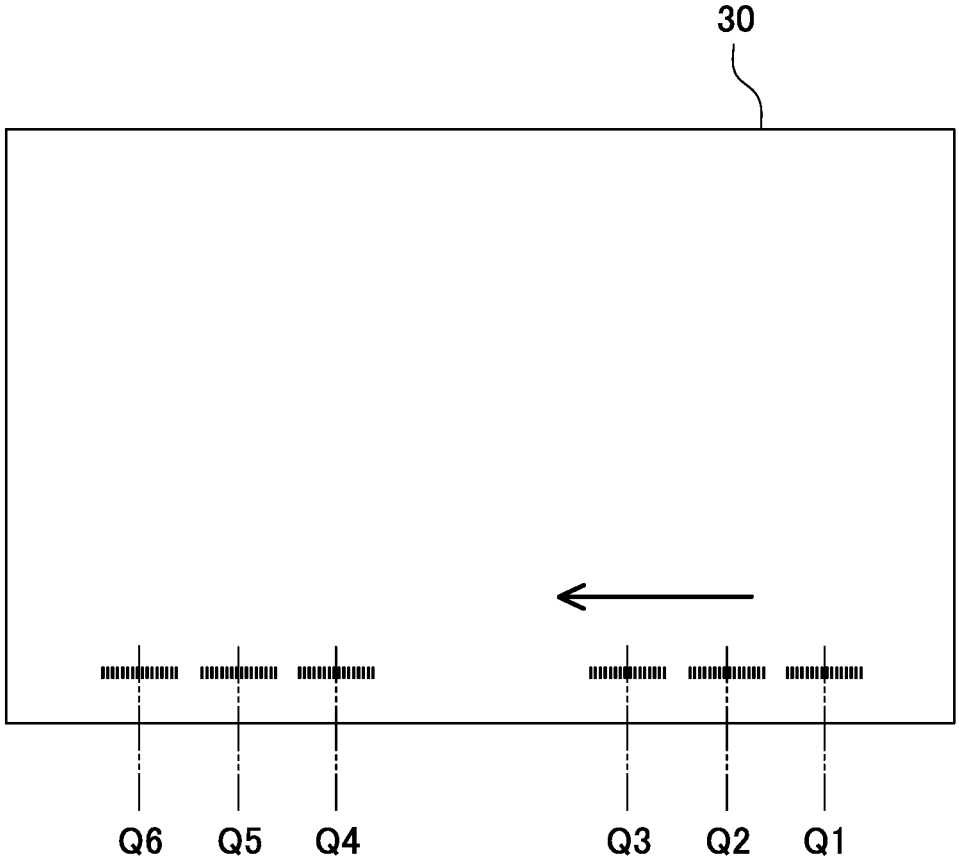
FIG. 17 is a plan view showing a plurality of binding positions in the two-point binding mode.

FIG. 15 is an operation flowchart of the two-point binding mode processing. If the two-point binding mode is selected, the sheet post-processing control unit 13*a* controls the unit moving mechanism 69 (see FIG. 2) to move the binding unit 64 located at the home position HP in the direction parallel to the one side of the sheets 30 as shown in FIG. 16A (step S211). In the present example, the number of binding points is three. As shown in FIG. 17, three binding positions Q1, Q2, and Q3 are set in a first effective binding region, and three binding positions Q4, Q5, and Q6 are set in a second effective binding region.

Figure 16B:
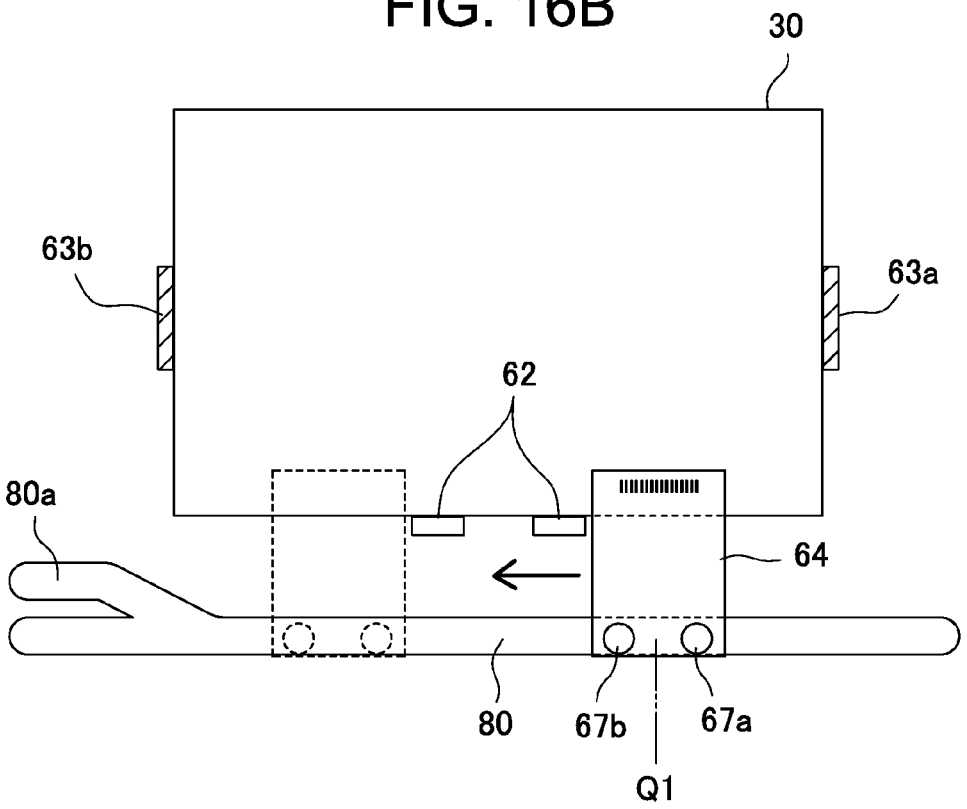

As shown in FIG. 16B, if the binding unit 64 reaches the first binding position Q1, the sheet post-processing control unit 13*a* stops the binding unit 64 (step S212), and drives the binding motor M4 to apply binding to the binding position Q1 of the sheets 30. Like the corner binding mode, the sheet post-processing control unit 13*a* then determines whether binding has been completed as many times as the set number of binding points (step S213). If binding has not been completed as many times as the set number of binding points, the sheet post-processing control unit 13*a* controls the unit moving mechanism 69 to move the binding unit 64 in the direction parallel to the one side of the sheets 30 (step S214). The sheet post-processing control unit 13*a* then drives the binding motor M4 to apply binding to the next binding position Q2 (step S215).

After the application of the binding to the binding position Q2, the sheet post-processing control unit 13*a* checks again whether binding has been completed as many times as the set number of binding points (step S213). If binding has not been completed as many times as the set number of binding points, the sheet post-processing control unit 13*a* moves the binding unit 64 to the set next binding position Q3 and applies binding. The sheet post-processing control unit 13*a* then repeats the operation of steps S213 to S215 until binding is completed as many times as the set number of binding points. More specifically, the sheet post-processing control unit 13*a* moves the binding unit 64 to the binding positions Q1 to Q6 of the sheets 30 and repeats the operation for applying binding.

In the two-point binding mode, the binding points are grouped in twos. The sheet post-processing apparatus according to the present embodiment has three levels of operation of fastening force, "high", "normal", and "low". If the fastening force is set to "high", the sheet post-processing apparatus performs binding at six points. If the fastening force is set to "normal", the sheet post-processing apparatus performs binding at four points. If the fastening force is set to "low", the sheet post-processing apparatus performs binding at two points.

As described above, in the case of the two-point binding mode, the sheet post-processing control unit 13*a* controls the binding tool 70 to apply the binding processing to a plurality of binding points along the direction of the one side of the sheets 30. If the binding positions lie in positions parallel to the side of the sheets 30, then the sheet post-processing control unit applies the binding processing along the direction of the side.

After binding has been applied to the sheets 30 as many times as the set number of binding points, the sheet post-processing control unit 13*a* returns the binding unit 64 to the home position HP and ends the two-point binding mode processing (step S216).

Figure 11A:
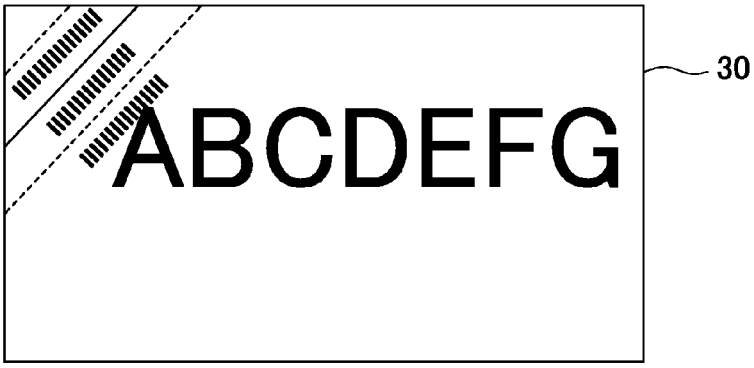
FIGS. 11A and 11B are plan views showing states in which the binding processing is stopped.
Figure 11B:
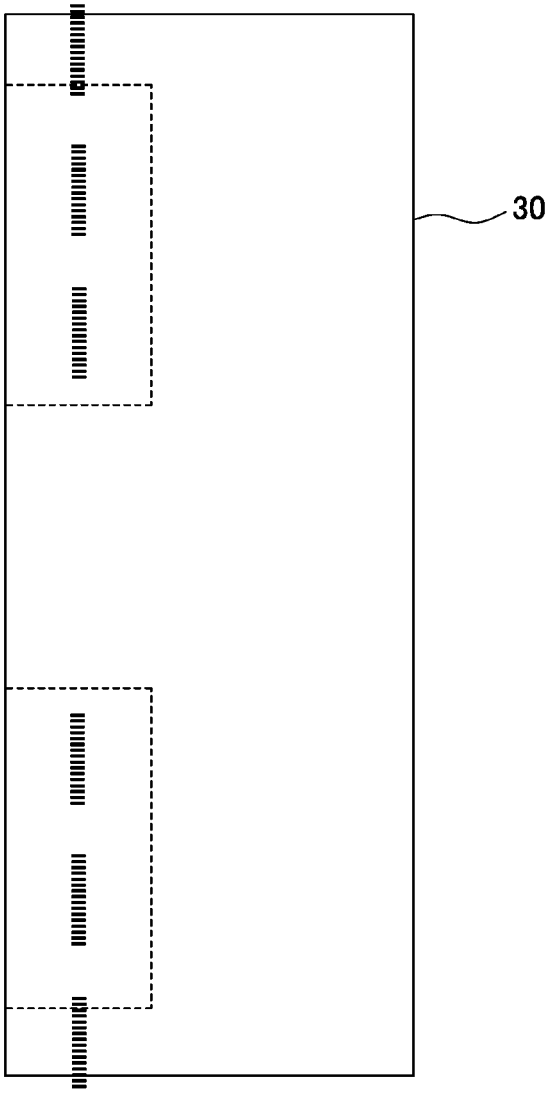
Figure 18:
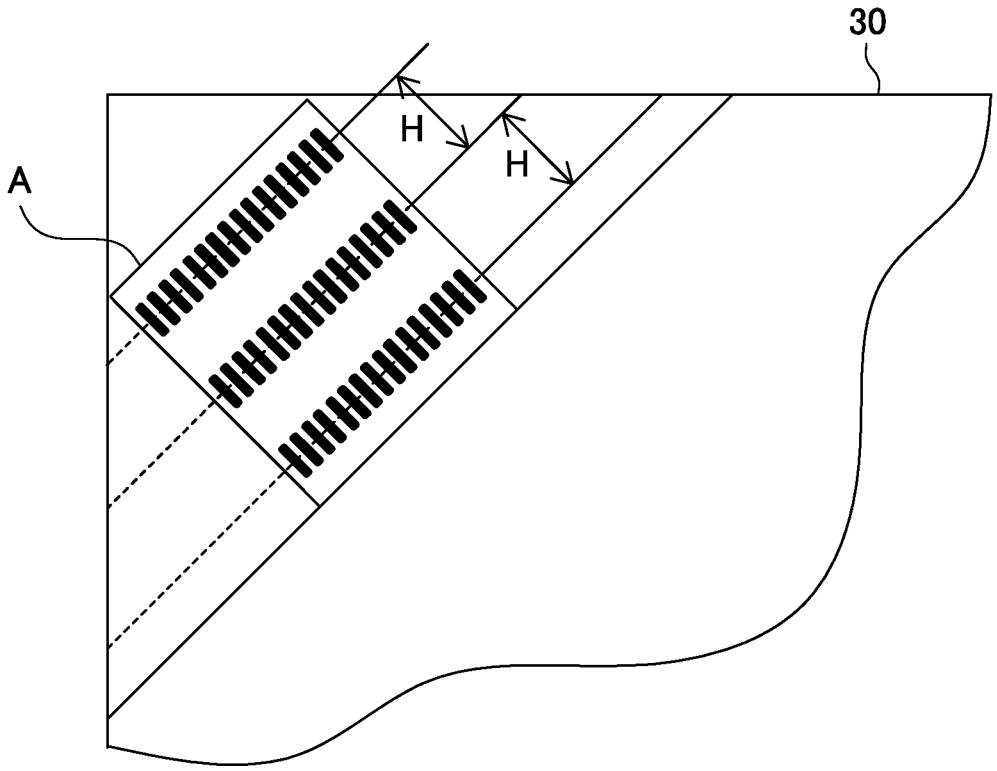
FIG. 18 is a plan view showing a modification of the plurality of binding positions in the corner binding mode.

In the foregoing embodiment, the effective binding region(s) is/are divided into equal blocks according to the number of binding points, and binding positions are set at the centers of the respective blocks. However, as shown in FIG. 18, binding positions may be set at a constant pitch H from one end side to the other end side of an effective binding region regardless of the number of binding points. If binding positions are set at a constant pitch H, a binding position can overlap with a printed character or the like as shown in FIG. 11A. Binding positions can exceed the effective binding regions as shown in FIG. 11B. In such cases, the sheet post-processing control unit 13*a* determines that binding positions are unable to be set. The sheet post-processing control unit 13*a* then informs the user that the binding mode and the number of binding points input from the input unit 14*a* are not executable.

Figure 19A:
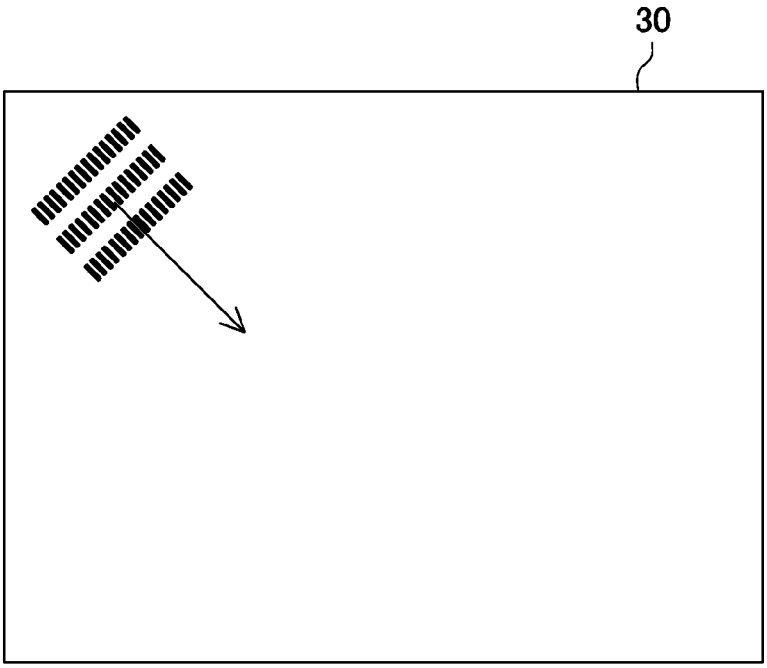
FIGS. 19A, 19B, and 19C are plan views showing patterns of a binding direction of a plurality of binding positions.
Figure 19B:
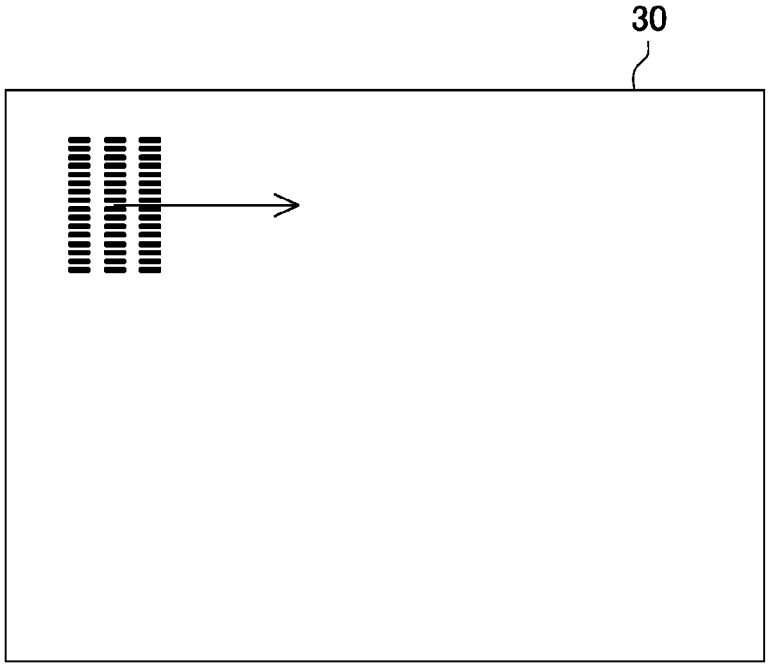
Figure 19C:
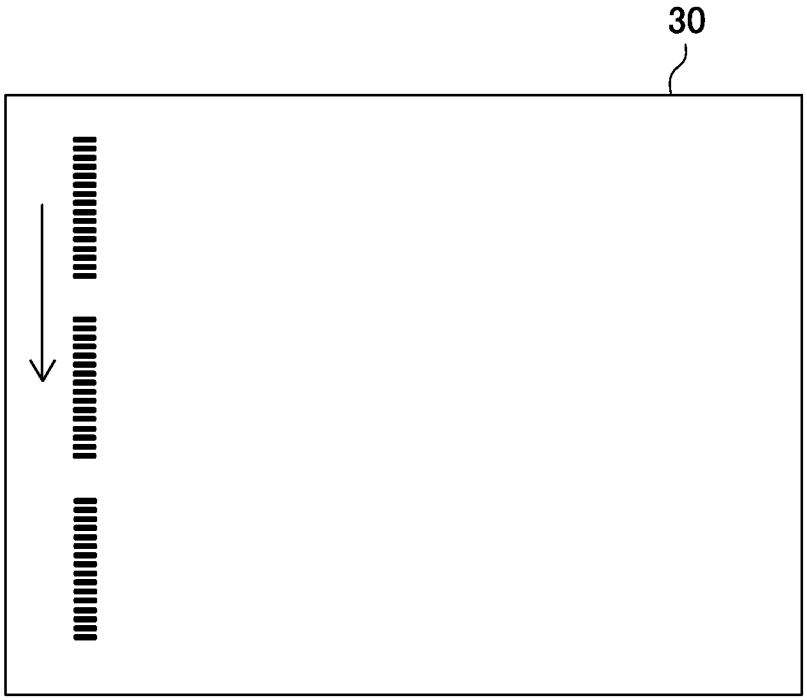

In the foregoing embodiment, the corner binding uses oblique binding in which the sheets are bound in a direction crossing the two sides of the corner as shown in FIG. 19A. However, parallel binding may be used in which the crimps are directly opposed to the opposite sides of the sheets 30. If there is a plurality of binding points, binding positions are set toward the center along a side of the sheets as shown in FIG. 19B. Oblique binding and parallel binding both may be made available so that the user can arbitrarily select one. A mode in which parallel binding is applied to one location at arbitrary position on the one side of the sheets 30 may be provided aside from the corner binding mode and the two-point binding mode. If the number of binding points is more than one, binding positions may be set along one side of the sheets 30 and parallel binding may be applied as shown in FIG. 19C.

According to the foregoing embodiment, the binding force is manually set by using the operation buttons "high", "normal", and "low" provided on the input unit 14*a*. However, the main body control unit 12*a* or the sheet post-processing control unit 13*a* may automatically determine and set an appropriate number of binding points and appropriate binding positions based on information about sheet types, such as thin paper, plain paper, thick paper, and special paper, and the binding mode information input from the input unit 14*a*.

The sheet post-processing apparatus 4 described above is configured to be able to set the number of binding points, and can thereby freely adjust the fastening force of a sheet bundle. This allows appropriate binding according to the number of sheets in the sheet bundle, the type of the sheets, and the like. Since the fastening force of the sheet bundle can be freely adjusted, binding desired by the user can be easily performed.

In the corner binding mode, the sheet post-processing apparatus 4 performs binding on a plurality of points toward the inner side of the sheets 30. In the two-point binding mode, the sheet post-processing apparatus 4 performs binding on a plurality of points along the one side of the sheets 30. This can prevent interference with handling of the bound sheet bundle. In other words, if binding is applied to a plurality of points, the binding positions are set in a direction according to the binding mode. This offers excellent handling of the bound sheet bundle.

This application claims priority based on Japanese Patent Application No. 2016-179235, filed Sep. 14, 2016, all the contents of which are incorporated herein.

What is claimed is:

1. A sheet post-processing apparatus comprising:

a binding part that crimps a predetermined position on a sheet for binding; and a setting unit that sets the number of binding points at which to bind the sheet, wherein if the number of binding points set by the setting unit is more than one, the binding part applies binding to a plurality of binding points along a predetermined direction, and the setting unit obtains information about fastening force of the sheet, and sets the number of binding points based on the information about the fastening force.

2. The sheet post-processing apparatus according to claim 1, wherein the binding part applies binding to different positions depending on the number of binding points of the sheet, set by the setting unit.

3. The sheet post-processing apparatus according to claim 1, wherein if the number of binding points of the sheet, set by the setting unit is more than one, the binding part applies binding at different intervals depending on the number of binding points.

4. The sheet post-processing apparatus according to claim 1, wherein if the number of binding points of the sheet, set by the setting unit is more than one, the binding part applies binding at a constant interval.

5. A sheet post-processing apparatus comprising:

a binding part that binds a sheet by crimping;

a first setting unit that sets the number of binding points at which to bind the sheet;

a second setting unit that sets a binding position or positions on the sheet based on the number of binding points set by the first setting unit; and a control unit that controls the binding part to apply binding to the binding position(s) set by the second setting unit, wherein if the number of binding points set by the first setting unit is more than one, the second setting unit sets a plurality of binding positions along a predetermined direction, and the control unit controls the binding part to apply binding to the plurality of binding positions along the predetermined direction, and the second setting unit, in oblique binding processing in which binding is applied to a corner of two sides of the sheet in a direction crossing the two sides, sets the plurality of binding points in a direction toward a center of the sheet, and in parallel binding processing in which binding is applied along one side of the sheet, sets the plurality of binding positions in a direction along the one side of the sheet.

6. A sheet post-processing apparatus comprising:

a binding part that binds a sheet by crimping;

a first setting unit that sets the number of binding points at which to bind the sheet;

a second setting unit that sets a binding position or positions on the sheet based on the number of binding points set by the first setting unit; and a control unit that controls the binding part to apply binding to the binding position(s) set by the second setting unit, wherein if the number of binding points set by the first setting unit is more than one, the second setting unit sets a plurality of binding positions along a predetermined direction, and the control unit controls the binding part to apply binding to the plurality of binding positions along the predetermined direction;

the sheet post-processing apparatus has a corner binding mode in which binding processing is applied to a corner of two sides of the sheet, and a two-point binding mode in which the binding processing is applied to two points along one side of the sheet; and the second setting unit, in the corner binding mode, sets the plurality of binding positions in a direction toward a center of the sheet, and in the two-point binding mode, sets the plurality of binding positions in a direction along one side of the sheet.

7. A sheet post-processing apparatus comprising:

a binding part that binds a sheet by crimping;

a first setting unit that sets the number of binding points at which to bind the sheet;

a second setting unit that sets a binding position or positions on the sheet based on the number of binding points set by the first setting unit; and a control unit that controls the binding part to apply binding to the binding position(s) set by the second setting unit, wherein if the number of binding points set by the first setting unit is more than one, the second setting unit sets a plurality of binding positions along a predetermined direction, and the control unit controls the binding part to apply binding to the plurality of binding positions along the predetermined direction, and if at least one binding position set by the second setting unit lies outside a predetermined binding region, the control unit stops a binding operation of the binding part.

8. A sheet post-processing apparatus comprising:

a binding part that binds a sheet by crimping;

a first setting unit that sets the number of binding points at which to bind the sheet;

a second setting unit that sets a binding position or positions on the sheet based on the number of binding points set by the first setting unit; and a control unit that controls the binding part to apply binding to the binding position(s) set by the second setting unit, wherein if the number of binding points set by the first setting unit is more than one, the second setting unit sets a plurality of binding positions along a predetermined direction, and the control unit controls the binding part to apply binding to the plurality of binding positions along the predetermined direction, and if binding traces in at least two binding positions set by the second setting unit overlap, the control unit stops a binding operation of the binding part.

9. An image forming system comprising:

an image forming unit that forms an image on a sheet;

a processing tray that performs post-processing on the sheet on which the image is formed by the image forming unit;

a binding part that binds the sheet on the processing tray by crimping;

an operation unit that inputs processing information for performing the post-processing on the sheet;

a first setting unit that sets the number of binding points of the sheet based on the processing information input by the operation unit;

a second setting unit that sets a binding position or positions of the sheet based on the number of binding points set by the first setting unit; and a control unit that controls the binding part to apply binding to the binding position(s) set by the second setting unit, wherein if the number of binding points set by the first setting unit is more than one, the second setting unit sets a plurality of binding positions along a predetermined direction, and the control unit controls the binding part to apply binding to the plurality of binding positions along the predetermined direction, and the processing information input by the operation unit includes at least information about fastening force of the sheet.

10. The image forming system according to claim 9, further comprising:

a positioning unit that positions the sheet to a predetermined position on the tray; and a moving unit that moves the binding part along one side of the positioned sheet, wherein the control unit controls the moving unit and the binding part to apply binding to a plurality of binding positions.

* * * * *